US010519592B2

(12) United States Patent
Del Pos et al.

(10) Patent No.: US 10,519,592 B2
(45) Date of Patent: Dec. 31, 2019

(54) APPLIANCE FOR DRYING LAUNDRY PROVIDING DRYING AIR RECIRCULATION AND MOISTURE CONDENSATION

(71) Applicant: Electrolux Home Products Corporation, Brussels (BE)

(72) Inventors: Maurizio Del Pos, Pordenone (IT); Alberto Bison, Pordenone (IT); Massimiliano Vignocchi, Pordenone (IT); Loris Padovan, Sesto al Reghena (IT)

(73) Assignee: Electrolux Home Products Corporation N.V. (BE)

( * ) Notice: Subject to any disclaimer, the term of this patent is extended or adjusted under 35 U.S.C. 154(b) by 0 days.

(21) Appl. No.: 14/950,079

(22) Filed: Nov. 24, 2015

(65) Prior Publication Data

US 2016/0076192 A1 Mar. 17, 2016

Related U.S. Application Data

(62) Division of application No. 13/381,512, filed as application No. PCT/EP2010/058519 on Jun. 17, 2010, now abandoned.

(30) Foreign Application Priority Data

Jun. 29, 2009 (EP) ..... 09164002

(51) Int. Cl.
*D06F 58/24* (2006.01)
*D06F 58/18* (2006.01)

(52) U.S. Cl.
CPC ..... *D06F 58/24* (2013.01); *D06F 58/18* (2013.01)

(58) Field of Classification Search
CPC ..... D06F 58/24; D06F 58/18; D06F 58/16; D06F 58/20; D06F 25/00; D06F 58/04; D06F 58/206; D06F 58/10; B01D 46/001
(Continued)

(56) References Cited

U.S. PATENT DOCUMENTS 2,722,057 A 11/1955 Pugh
3,190,011 A * 6/1965 Shields ..... D06F 43/086 34/607

(Continued)

FOREIGN PATENT DOCUMENTS

CH 462085 A 9/1968
DE 1610198 A1 8/1971

(Continued)

OTHER PUBLICATIONS

Russian Office Action dated Jul. 15, 2014 in related Russian Application No. 2012102983.

(Continued)

*Primary Examiner* — Kenneth Rinehart
*Assistant Examiner* — Bao D Nguyen
(74) *Attorney, Agent, or Firm* — RatnerPrestia

(57) ABSTRACT

A laundry drying appliance (100) includes a cabinet (110) having a top (119), a rotating drum (105) accommodated within a tub (303) housed in the cabinet, and a laundry drying air circulation system for circulating drying air. The drying air circulation system includes a drying air return duct (305) through which drying air coming from drum flows. The drying air return duct has an outlet (310), and a drying air delivery duct (205,215) through which the drying air is sent back to the drum. The drying air delivery duct has an inlet (210). The top forms a ready-to-mount moisture condensing module ready to be mounted to the cabinet for dehydrating drying air used to dry laundry within the drying (Continued)

drum of the laundry drying appliance. The top has a drying air inlet (510) couplable to the outlet of the drying air return duct, a drying air outlet (515) couplable to the inlet of the drying air delivery duct, fluid passageways defined inside the top from said drying air inlet to the drying air outlet for the passage of the drying air to be dehydrated. Moisture condensing means are arranged inside the fluid passageways.

14 Claims, 18 Drawing Sheets

(58) Field of Classification Search
USPC ..... 34/73, 74, 108, 604, 140; 68/20
See application file for complete search history.

(56) References Cited

U.S. PATENT DOCUMENTS

| | | | | |
|---|---|---|---|---|
| 3,805,404 | A | 4/1974 | Gould | |
| 4,137,645 | A | 2/1979 | Bullock | |
| 4,268,247 | A | 5/1981 | Freze | |
| 4,519,145 | A | 5/1985 | Mandel | |
| 4,949,477 | A * | 8/1990 | Geiger | D06F 58/02 34/140 |
| 5,042,172 | A * | 8/1991 | Foco | D06F 58/20 138/135 |
| 5,367,787 | A | 11/1994 | Ikeda et al. | |
| 5,588,313 | A * | 12/1996 | Hildebrand | D06F 25/00 68/17 R |
| 6,234,893 | B1 | 5/2001 | Meredith | |
| 6,954,995 | B2 | 10/2005 | Kitamura et al. | |
| 7,347,009 | B2 | 3/2008 | Ahn et al. | |
| 7,367,137 | B2 | 5/2008 | Jonsson et al. | |
| 7,716,850 | B2 | 5/2010 | Deem et al. | |
| 7,921,578 | B2 | 4/2011 | McAllister et al. | |
| 8,028,439 | B2 | 10/2011 | Prajescu | |
| 8,112,904 | B2 | 2/2012 | Kono et al. | |
| 8,490,438 | B2 | 7/2013 | Kim et al. | |
| 8,919,009 | B2 | 12/2014 | Colombo et al. | |
| 9,207,015 | B2 | 12/2015 | Ahn et al. | |
| 9,228,293 | B2 | 1/2016 | Yeom | |
| 9,273,903 | B2 | 3/2016 | Vian et al. | |
| 9,297,493 | B2 | 3/2016 | Bison et al. | |
| 9,335,095 | B2 | 5/2016 | Bison et al. | |
| 9,359,714 | B2 | 6/2016 | Contarini et al. | |
| 9,372,031 | B2 | 6/2016 | Contarini et al. | |
| 9,435,069 | B2 | 9/2016 | Contarini et al. | |
| 9,534,329 | B2 | 1/2017 | Contarini et al. | |
| 9,845,567 | B2 | 12/2017 | Contarini et al. | |
| 2004/0079121 | A1 * | 4/2004 | Yabuuchi | D06F 25/00 68/19.2 |
| 2005/0262885 | A1 * | 12/2005 | Byun | D06F 25/00 68/19.2 |
| 2005/0278972 | A1 * | 12/2005 | Maruca | D06F 58/20 34/201 |
| 2006/0277690 | A1 * | 12/2006 | Pyo | D06F 25/00 8/149.2 |
| 2007/0144032 | A1 * | 6/2007 | Maruca | D06F 58/10 34/469 |
| 2007/0151120 | A1 | 7/2007 | Tomasi et al. | |
| 2011/0265523 | A1 | 11/2011 | Bison et al. | |
| 2014/0026433 | A1 | 1/2014 | Bison et al. | |
| 2014/0190220 | A1 | 7/2014 | Lee et al. | |
| 2014/0250607 | A1 | 9/2014 | Favaro et al. | |
| 2017/0002506 | A1 | 1/2017 | Contarini et al. | |

FOREIGN PATENT DOCUMENTS

| | | | |
|---|---|---|---|
| DE | 7147026 | | 3/1972 |
| DE | 2839389 | A1 | 3/1980 |
| DE | 19504034 | A1 | 9/1995 |
| EP | 254018 | A1 | 1/1988 |
| EP | 0552843 | A1 | 7/1993 |
| EP | 1146161 | | 10/2001 |
| EP | 1411163 | A2 | 4/2004 |
| EP | 1431442 | | 6/2004 |
| EP | 1584734 | A2 | 10/2005 |
| EP | 1634984 | A1 | 3/2006 |
| EP | 1845185 | | 10/2007 |
| EP | 1854916 | | 11/2007 |
| EP | 2039819 | A1 | 3/2009 |
| EP | 2199453 | A1 | 6/2010 |
| EP | 2270274 | A1 | 1/2011 |
| EP | 2385163 | A1 | 11/2011 |
| GB | 2075559 | A | 11/1981 |
| GB | 2248920 | A | 4/1992 |
| JP | 2004135715 | A | 5/2004 |
| RU | 1587093 | | 8/1990 |
| WO | 1995/028515 | A1 | 10/1995 |
| WO | 2005106249 | A1 | 11/2005 |
| WO | 2006097901 | | 9/2006 |
| WO | 2009/077308 | A1 | 6/2009 |

OTHER PUBLICATIONS

Chinese Office Action dated May 15, 2014 in related Chinese Application No. 201080029650.9.
Opposition filed Jun. 25, 2014 against related European Patent No. 2270274.
Chinese Office Action dated Oct. 9, 2014 in related Chinese Application No. 201080029193.3.
Extended European Search Report issued in corresponding EP App No. 09164002.9, dated Sep. 30, 2009.
International Search Report and Written Opinion issued in corresponding International App No. PCT/EP2010/058519, dated Feb. 2, 2011.
International Search Report issued in related International App No. PCT/EP2010/058963, dated Sep. 17, 2010.
European Search Report issued in related European app No. 09164001.1, dated Nov. 18, 2009.
Office Action issued in related European App No. 09164001.1, dated Jul. 25, 2011.
International Search Report issued in related International App No. PCT/EP2010/058968, dated Dec. 8, 2010.
PCT/EP2011/074132, International Search Report, dated Mar. 28, 2012.
EP App No. 11150054.2, Extended European Search Report, dated Jul. 29, 2011.
EP App No. 11150054.2, European Office Action, dated Apr. 5, 2013.
EP App No. 09164001.1, EP Search Report, dated Nov. 18, 2009.
EP App No. 09164001.1, Office Action, dated Jul. 25, 2011.
EP App No. 09164002.9, Extended EP Search Report, dated Sep. 30, 2009.
International App No. PCT/EP2010/058519, ISR and Written Opinion, dated Feb. 2, 2011.
International App No. PCT/EP2010/058963, ISR, dated Sep. 17, 2010.
International App No. PCT/EP2010/058968, ISR, dated Dec. 8, 2010.
Non Final Office Action for U.S. Appl. No. 14/959,115, dated Jun. 21, 2018, 22 pages.
International Search Report for International Application No. PCT/EP2015/054608, dated Apr. 20, 2015, 3 pages.
Notice of Allowance for U.S. Appl. No. 14/959,115, dated Aug. 14, 2019, 8 pages.

* cited by examiner

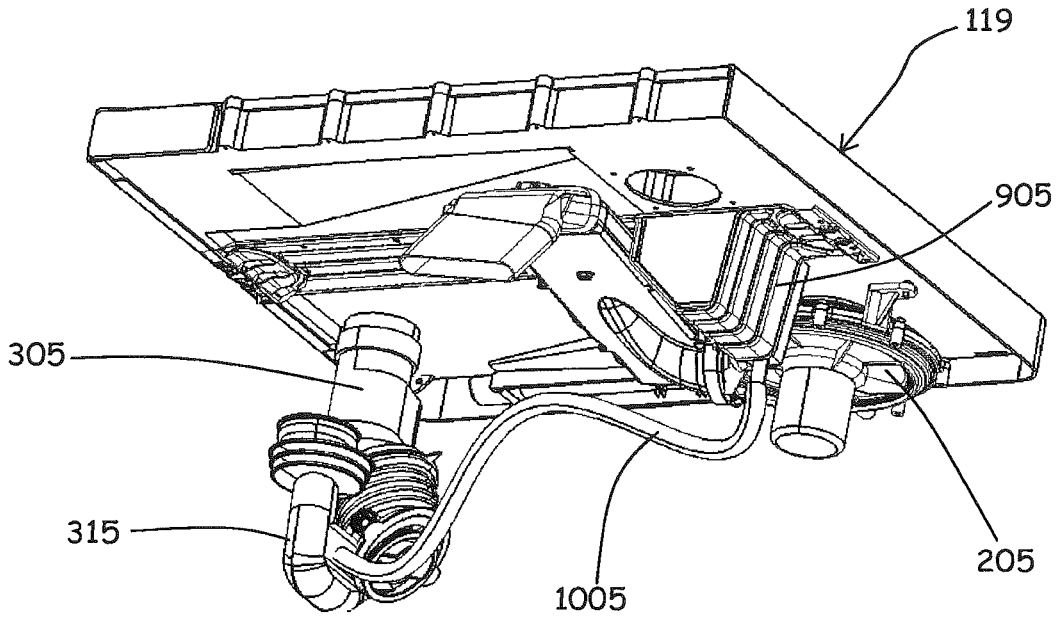
FIG. 10
FIG. 12
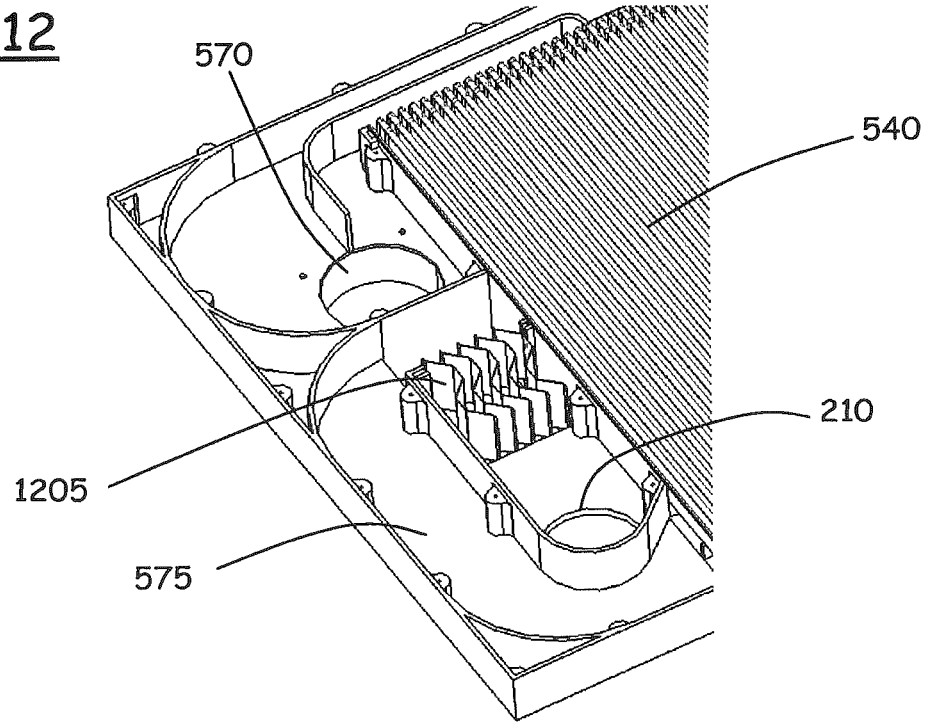

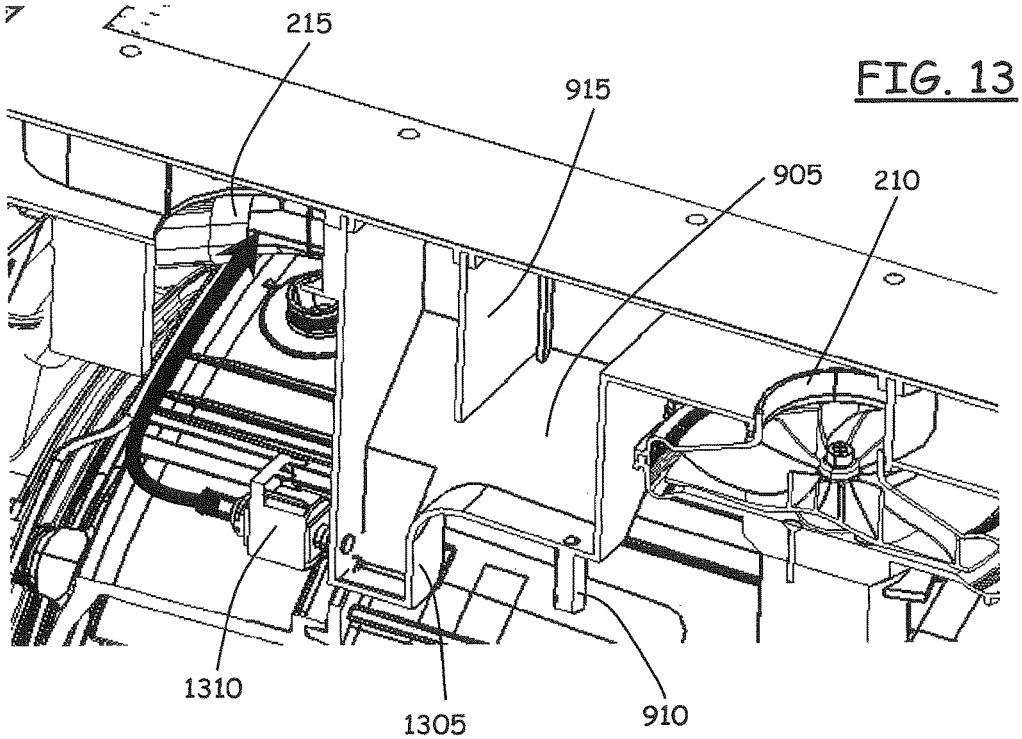
FIG. 13
FIG. 14A
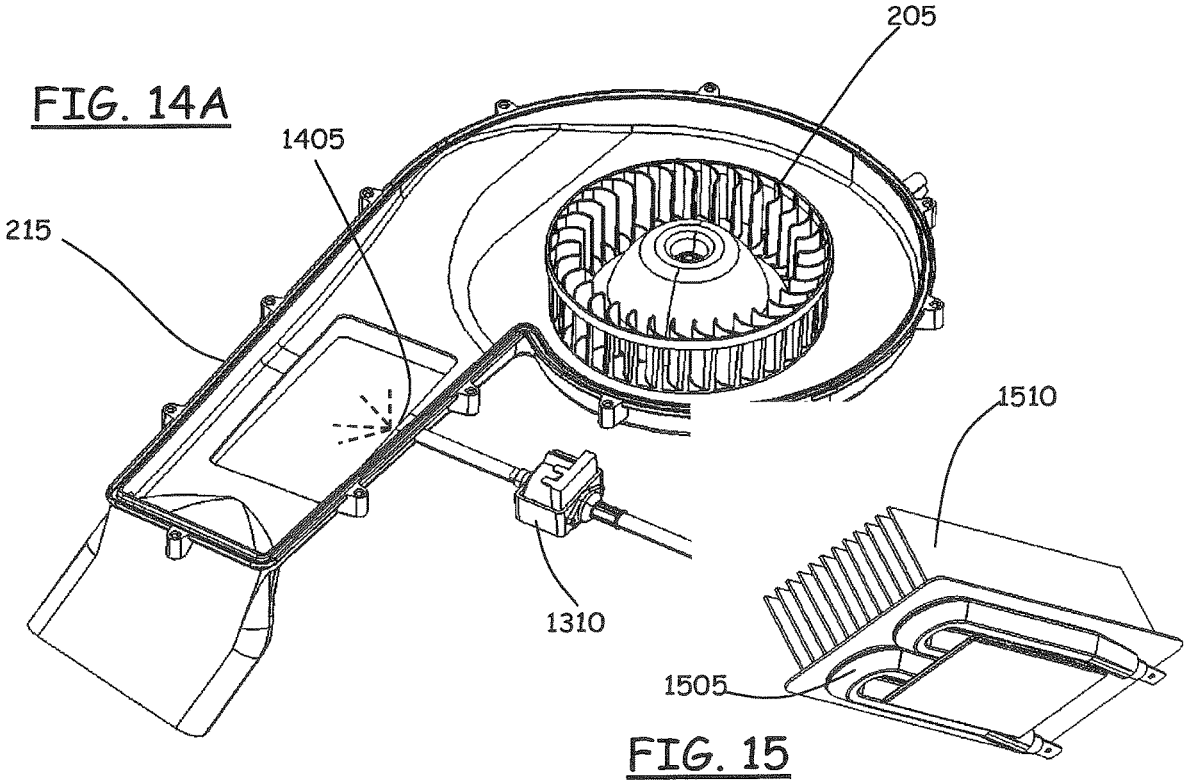
FIG. 15

APPLIANCE FOR DRYING LAUNDRY PROVIDING DRYING AIR RECIRCULATION AND MOISTURE CONDENSATION

BACKGROUND OF THE INVENTION

Field of the Invention

The present invention generally relates to the field of household appliances for laundry and garments treatment. In particular, the present invention relates to appliances for drying laundry, such as laundry dryers and combined washers/dryers.

Discussion of the Related Art

Appliances for drying laundry, are adapted to dry clothes, garments, laundry in general, by circulating hot, dry air within a tumbler or drum. The drum is rotatable within a tub, which is accommodated within a machine cabinet, and is designed to contain the articles to be dried. The rotation of the drum causes agitation of the articles to be dried, while they are hit by the drying air flow.

Combined laundry washer/dryer appliances combine the features of a washing machine with those of a dryer.

In a known type of laundry dryers and washers/dryers, also referred to as "condenser dryer", the drying air flow is typically caused to pass through the drum, exiting therefrom from the front access opening, then it passes through a moisture condensing system, where the humid air is at least partially dehydrated, dried, and the dried air flow is heated up by means of a heating arrangement, like an electrical resistance; the heated drying air flow then passes again through the drum, and repeats the cycle.

The condensing system may be an air-air heat exchanger, exploiting air taken in from the outside. Examples of laundry dryers exploiting this type of condensing system are provided in EP 254018, EP 1584734, EP 2039819, GB 2075559.

Other known dryers and washers/dryers exploit a heat pump to dehydrate the drying air flow; in these dryers, the function of the heating arrangement may be performed by the heat pump itself, and the electrical resistance may thus not be provided for. Examples of laundry dryers exploiting a heat pump condenser are provided in JP2004135715, EP 1411163, EP 1634984.

Other known solutions exploit a water spray condenser for cooling the drying air. For example, EP 0552843 describes a washing and drying machine including, for the drying part, a steam condenser communicating with the inside of the washing container to receive the steam emanated by the washed laundry contained in the drum and with a nozzle for spraying cold water for the condensation of said steam, an aspirator associated with said condenser for the aspiration of the condensed steam formed in said condenser and for its conveyance to a drying area for the formation of dry hot air and a recirculation conduit of dry hot air inside said container. A water spray condenser is also described in GB2248920.

For some household appliance manufacturers, it might be interesting to exploit the already existing design of a washer for producing and offering to the customers a washer/dryer. The addition of those components and parts, that are necessary for the laundry drying function, should have as low as possible impact on the already existing design; in particular, the additional components should be housed within the already existing washer cabinet. This may be a cumbersome task, because of space constraints.

SUMMARY OF THE INVENTION

The Applicant has faced the problem of how to reduce the encumbrance of the components necessary for the drying air circulation, particularly suitable for the implementation in a washer/dryer.

According to an aspect of the present invention, there is provided a laundry drying appliance comprising a cabinet having a top, a rotating drum accommodated within a tub housed in the cabinet, and a laundry drying air circulation system for circulating drying air.

The drying air circulation system comprises a drying air return duct through which drying air coming from drum flows, the drying air return duct having an outlet, and a drying air delivery duct through which the drying air is sent back to the drum, the drying air delivery duct having an inlet.

The top forms a ready-to-mount moisture condensing module ready to be mounted to the cabinet for dehydrating drying air used to dry laundry within the drying drum of the laundry drying appliance, the top having a drying air inlet couplable to said outlet of the drying air return duct, a drying air outlet couplable to said inlet of the drying air delivery duct, fluid passageways defined inside the top from said drying air inlet to said drying air outlet for the passage of the drying air to be dehydrated, and moisture condensing means arranged inside said fluid passageways.

Said outlet of the drying air return duct and said inlet of the drying air delivery duct are preferably located at the top of the cabinet and face upwards, and the top has a top surface and a bottom surface, said drying air inlet and said drying air outlet being provided on the bottom surface and facing downwards so as to match and be couplable to the outlet of the drying air return duct and to the inlet of the drying air delivery duct, respectively.

Advantageously, the drying air return duct and the drying air delivery duct are directly or indirectly rigidly connected to the cabinet so as to be stationary with respect to the cabinet to form automatic positioning and centering means for the mounting of the top.

The moisture condensing means accommodated in the top may comprise an air-air heat exchanger.

The air-air heat exchanger may comprise an ondulated thermally-conductive part, having ondulations defining channels for the passage of the drying air on the underside, and channels for the passage of cooling air from the overside, said cooling air being circulated by one among a tangential fan mounted to the top and a radial fan mounted to the top in correspondence of a cooling air discharge opening provided in the top.

The top may comprise a top panel having perforations for the leakage of the cooling air, said top panel being adapted to lay thereon garments to cause drying thereof by means of the leaking cooling air.

The moisture condensing means may alternatively comprise an evaporator of a heat pump, and wherein a heat pump condenser is further accommodated in the top inside the fluid passageways downstream said evaporator. The heat pump being fluidly coupled or couplable to a compressor which may either be attached to the top or be accommodated in correspondence of a basement of the laundry drying appliance.

In particular, the drying air return duct may be fluidly connected to a manifold which is also fluidly connected to a washing treatment products and water dispensing arrangement, the manifold having an inlet/outlet fluidly connected to the tub so as to receive drying air during a drying cycle and to deliver treatment products and water during a washing cycle, and wherein the manifold defines a siphon whereby an amount of liquid remains therein during the drying cycle to prevent drying air from leaking into the dispensing arrangement.

The top may comprise a condense water drainage outlet for draining condense water released by the drying air upon passing through the moisture condensing means; a condense water drainage conduit is provided fluidly connecting said condense water drainage outlet to a water discharge circuit of the appliance, particularly to said manifold.

The top may further comprise a sump for storing at least part of the condense water released by the drying air, and a water spraying system may be provided, adapted to take condense water present in said sump and spray the water into said drying air delivery conduit, the water being sprayed in correspondence of dry air heating means associated with said drying air delivery conduit for generating steam.

Said drying air delivery duct may comprise a drying air circulation fan.

Said fluid passageways formed in the top for the drying air may comprise a first air path portion from the drying air inlet to the moisture condensing means, and a second air path portion from the moisture condensing system to the drying air outlet.

A defluff filter is preferably accommodated in the first air path portion.

Condense water droplets separator means are preferably provided in the second air path portion of the fluid passageways defined in the top, for removing condense water droplets from the drying air before the drying air reaches the drying air outlet.

The condense water drainage outlet may in particular be provided in correspondence of said condense water droplets separator means.

The water droplets separator means may further comprise a condense water tank fluidly connected to the sump and to a point of said second path portion downstream of the water droplets separator means.

BRIEF DESCRIPTION OF THE DRAWINGS

These and other features and advantages of the present invention will better appear by reading the following detailed description of some embodiments thereof, provided merely by way of non-limitative examples, description that should be read in conjunction with the attached drawings, wherein:

FIG. 10 shows a condense water drainage arrangement for draining condense water from the worktop of FIGS. 5A and 5B;

FIG. 12 shows still another alternative embodiment of the mist separation means;

FIG. 13 schematically shows an arrangement for exploiting condense water released by the drying air for generating steam used for refreshing the items to be dried;

FIGS. 14A and 15 shows a solution for generating refreshing steam, in an embodiment of the present invention; in addition, FIG. 14A also shown an alternative construction of a drying air circulation fan and drying air conduit for delivering drying air to the drum;

DETAILED DESCRIPTION OF EMBODIMENTS OF THE INVENTION

Figure 1:
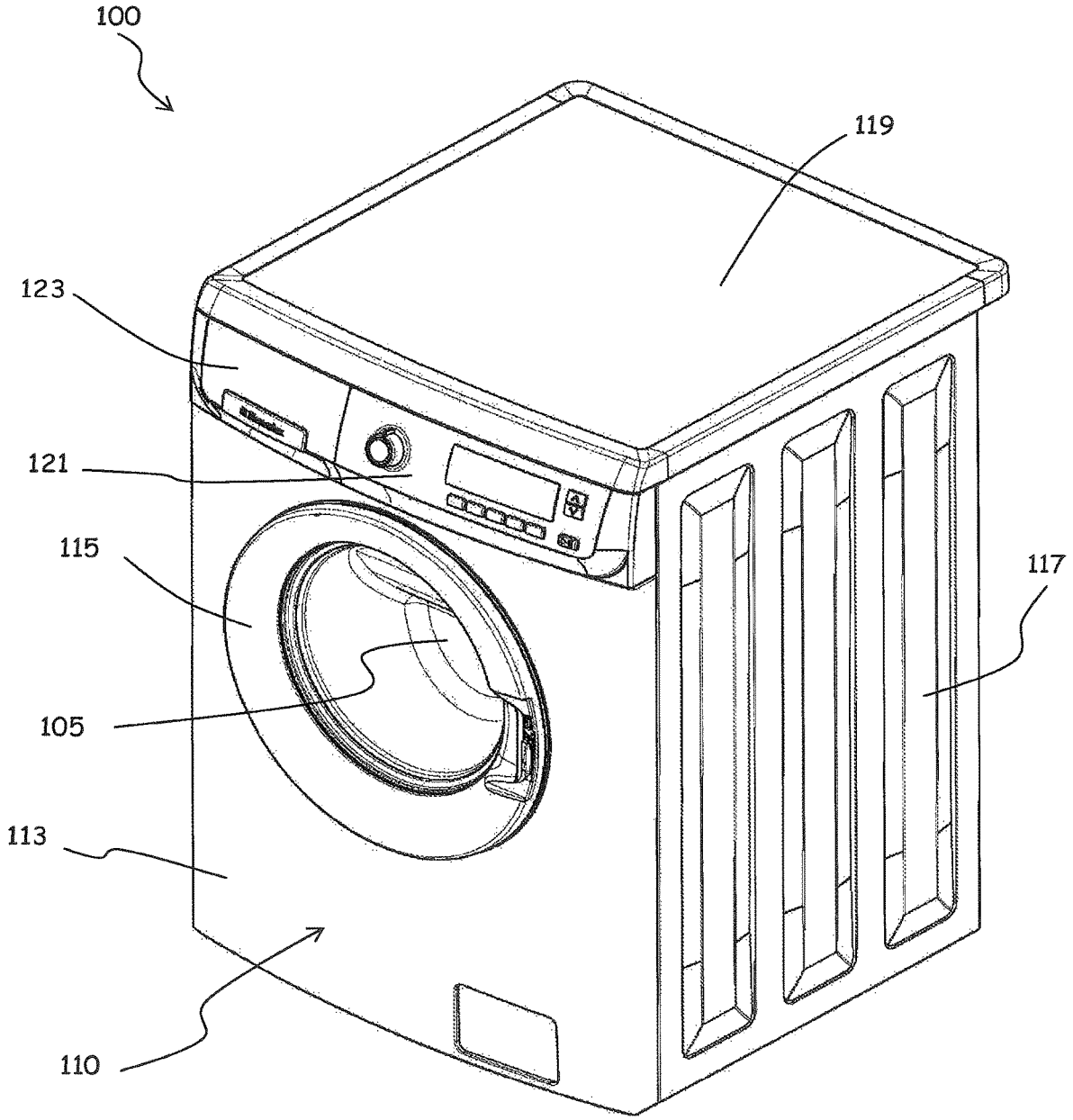
FIG. 1 is a perspective from the front of an appliance for drying laundry according to an embodiment of the present invention.

With reference to the drawings, a laundry drying appliance, particularly a washer/dryer according to an embodiment of the present invention is depicted in FIG. 1 in perspective. The washer/dryer, globally denoted as 100, comprises a drum 105 for the loading of the articles to be washed and/or dried, such as clothes, garments, linen, and similar articles. The drum 105 is a generically cylindrical body, for example made of stainless steel, and is rotatable within a tub housed in the machine casing or cabinet 110.

The cabinet 110 is generically a parallelepiped in shape, and has a front wall 113, two side walls 117, a rear wall, a basement and a top 119. The front wall 113 is provided with an opening for accessing the drum 105 and with an associated door 115 for closing the opening. In the upper part of the front wall 113, a machine control panel 121 is located, and, aside the control panel 121, a drawer 123, part of a washing treatment products dispensing arrangement, for loading laundry washing treatment products like detergents and softeners. The top 119 closes the cabinet 110 from above, and defines a worktop.

In the washer/dryer 100, when operated in dryer mode, drying air is typically caused to flow through the drum 105, where the items to be dried are contained. After exiting the drum 105, the flow of moisture-laden drying air passes through a moisture condensing system, where the humid drying air is at least partially dried, and dehydrated, and the dehydrated air flow is then heated and caused to pass again through the drum 105, repeating the cycle.

In the following, two solutions (and some possible variants thereof) according to embodiments of the present invention will be presented; the two solutions mainly differ from each other in the type of moisture condensing system employed, which in one case comprises an air-air heat exchanger, whereas in the other case the condensing system comprises a heat pump.

FIGS. 2 to 16 show, in different views, a solution according to a first embodiment of the present invention, in which the moisture condensing system comprises, as mentioned, an air-air heat exchanger, described in detail in the following.

Figure 2:
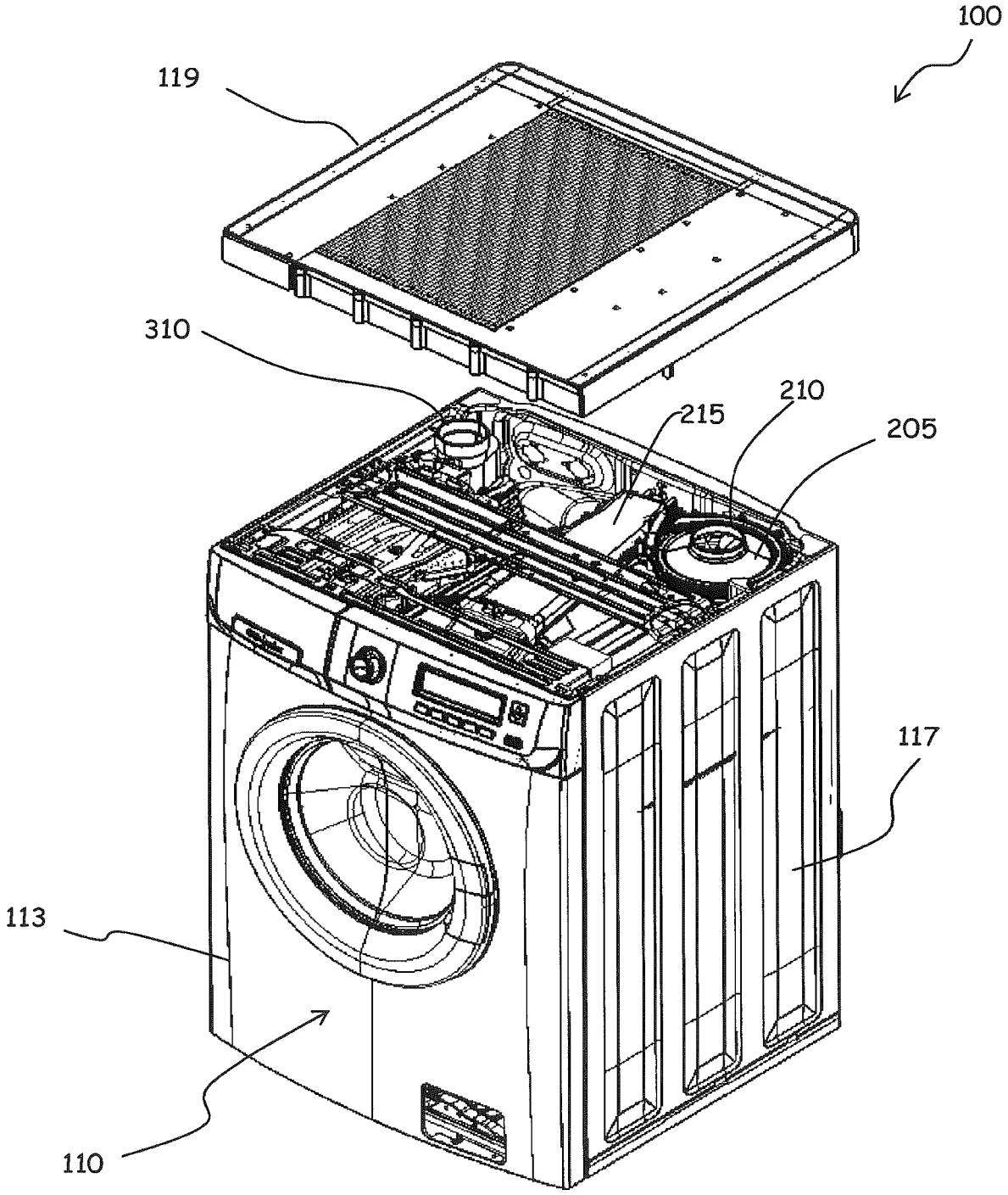
FIG. 2 shows in perspective the appliance of FIG. 1 with a worktop unmounted.
Figures 3A, 3B:
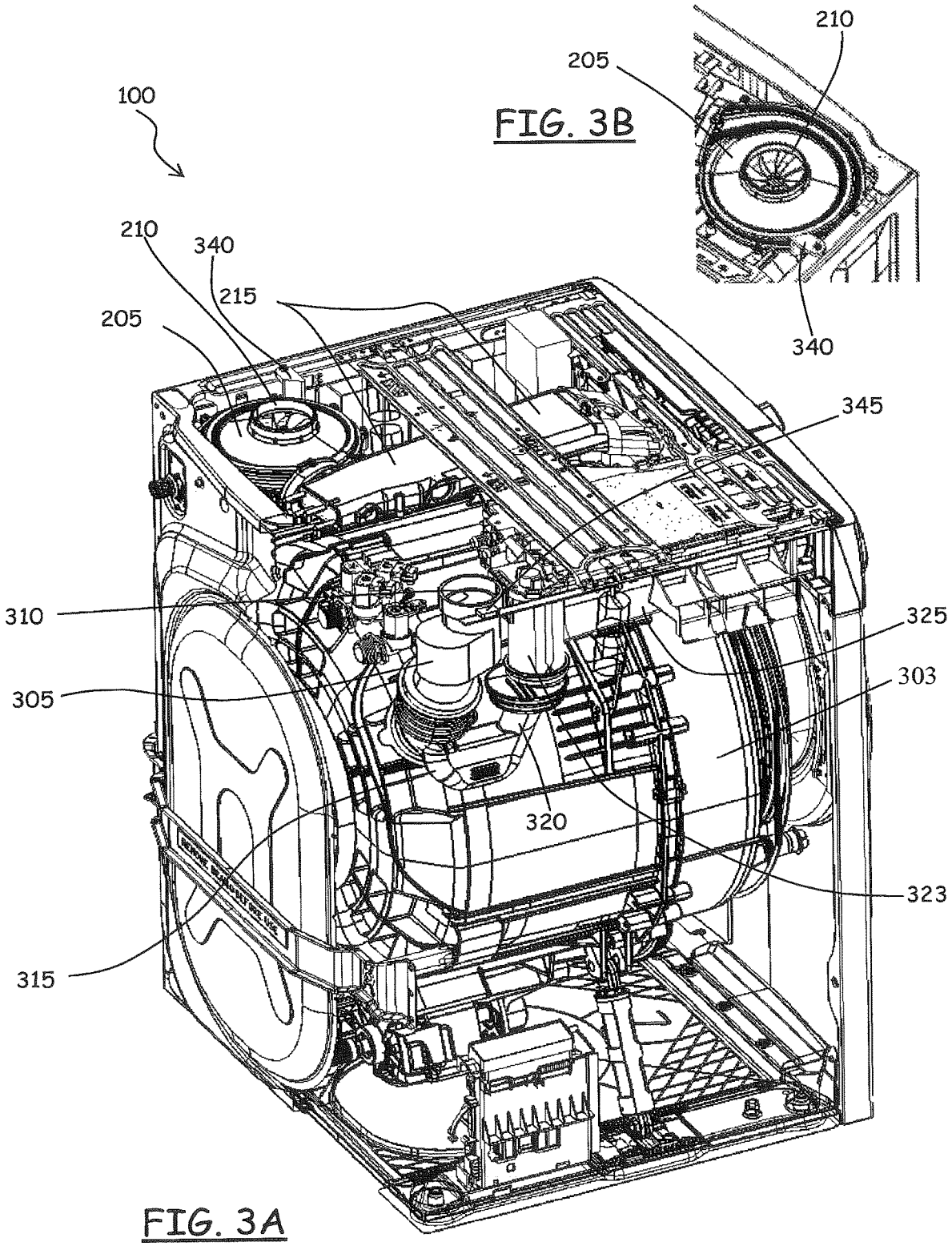
FIG. 3A shows in perspective from the rear the appliance of FIG. 2, with lateral and rear walls of the cabinet removed.
FIG. 3B shows a detail of FIG. 3A from another point of view.

As visible in particular in FIGS. 2 and 3A, 3B, a drying air circulation system is provided in the washer/dryer 100. The drying air circulation system comprises a fan 205, arranged at the rear of the cabinet 110, near the right-top corner thereof. The fan 205, which is fixedly mounted to the cabinet 110, for example by means of a bracket 340 so as to be preferably rigidly connected to the cabinet 110, has an air intake 210 facing upwards and which opens towards the top 119. The fan 205 has an outlet coupled to an inlet of an air duct 215 that runs at the top of the cabinet 110 from the rear to the front thereof, and, through a bellow, conveys the drying air from the fan 205 into the tub 303 and the drum 105 accommodated therein; in particular, the drying air enters the drum 105 in correspondence with the front thereof. An air heater is preferably accommodated within the air duct 215, for example an electrical resistor, so as to heat up the drying air before it enters the drum 105. The drying air circulation system further comprises a return air duct 305, arranged at the rear of the cabinet 110, near the left-top corner thereof and fixedly mounted to the cabinet 110, for example by means of a bracket 345, so as to be preferably rigidly connected to the cabinet 110; the return air duct 305 receives the drying air exiting the drum 105 and the tub 303, and has an outlet 310 that faces upwards and opens towards the top 119; in particular, the drying air exits the drum 105 at the rear thereof, after having passed through the drum so as to hit the items to be dried that are present therein.

Figure 4:
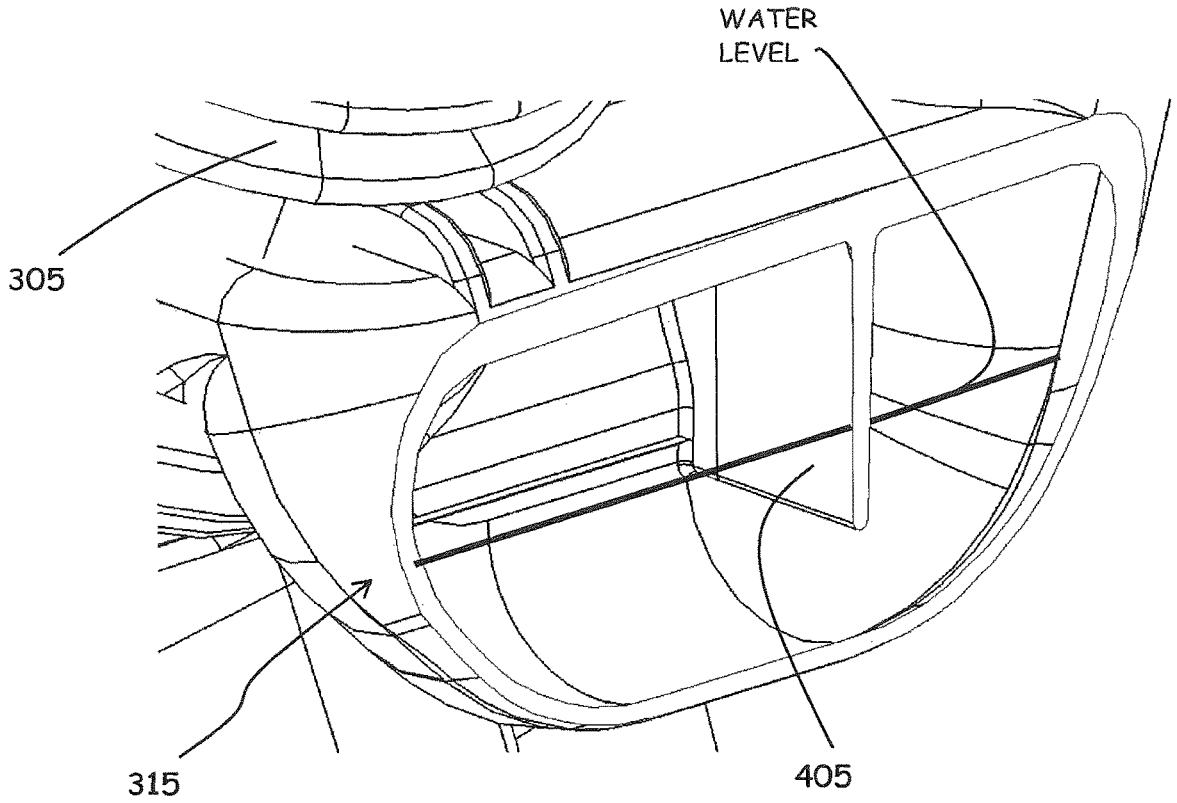
FIG. 4 shows in enlarged scale a detail of a part of the appliance of FIG. 3A.

As visible in FIGS. 3A, 3B and 4, according to a preferred embodiment of the present invention, the return air duct 305 receives the drying air exiting the drum 105 and the tub 303 through an opening in the tub 303 already provided for feeding thereto the laundry washing treatment products (detergents, softeners) and the clean water used to wash the laundry when the washer/dryer is operated in washing mode. In particular, a manifold 315 is provided, coupled to the opening in the tub 303. The manifold 315 has an inlet pipe 320 that is coupled, by means of a bellow and a duct 323, to an arrangement 325 for dispensing to the tub 303 the laundry washing treatment products (the dispensing arrangement comprising for example a detergent/softener container, one or possibly two electrovalves for intaking cold and possibly hot water from water mains, possibly a mixing chamber for mixing treatment products and water). The manifold 315 has an outlet opening to which, by means of a bellow, the return air duct 305 is connected. Internally, the manifold 315 has a baffle 405 extending down from a top wall of the manifold 315 and defining a siphon: the siphon allows that part of the laundry washing treatment liquid (water mixed with the detergent of the softener, or, possibly, simply water) remains at the bottom of the manifold 315, thereby preventing that, when the appliance is operated in drying mode, the drying air exiting the tub 303 leaks into the treatment products dispending arrangement 325, and that heat is lost, and, at the same time, that humid, moisture-laden air is released into the external environment, which is regarded as undesired because the washer/dryer is installed in-house.

Part of the drying air circulation system is entirely accommodated within the top 119. As visible in the exploded view of FIG. 5A, the top 119 comprises a base element 505, visible from below in FIG. 5B, having shape and size adapted to match and close from above the cabinet 110 when the top 119 is mounted thereto. Proximate to the two rear corners thereof, the base element 505 has two openings 510 and 515; as better described in the following, when the top 119 is assembled and placed on top of the cabinet 110, the opening 510 matches the outlet 310 of the return air duct 305, whereas the opening 515 matches the air intake 210 of the fan 205.

As visible in FIGS. 5A, 6 and 7A, 7B, an air path for the drying air is defined in the base element 505 by means of a series of walls. In particular, moisten-laden drying air, indicated by arrow 520 in FIG. 5A, coming from the drum 105 and the tub 303 through the return air duct 305, and entering into the top 119 through the opening 510, initially is caused to flow essentially parallel to the left side 525 of the top 119, from the rear to the front, and to pass through an air defluff filter that is removably accommodated within a respective filter seat 530 formed in the base element 505. Upon exiting the defluff filter, the drying air passes (arrow 533) through a moisture condenser comprising an air-air heat exchanger 535, so as to be cooled down and release moisture in the form of condense water. Advantageously, the air-air heat exchanger 535 is fully accommodated within the top 119, for example, as shown, in the central part thereof.

The air-air heat exchanger 535 comprises a corrugated sheet metal part 540, the undulations of which define channels for the passage of air. The corrugated sheet metal part 540 rests, both at the front and at the rear edges thereof, on a pair of comb-like structures 705 and 710, respectively arranged along a front wall 545 of the base element 505, and along a rear wall 550 of the base element 505. When assembled, the corrugated sheet metal part 540 is glued to the base element 505 by means of glue in between the comb-like structures 705 and 710. When the corrugated sheet metal part 540 rests on the comb-like structures 705 and 710, the undulations define, on the underside of the sheet metal part 540, channels for the flow of the drying air 533 to be cooled down, whereas on the upper side of the sheet metal part 540 the undulations define channels for the flow of cooling air 555 that, in the embodiment here considered, is taken in from the outside environment by means of a tangential fan 560 mounted to the rear wall 550 of the base element 505. The glue used to attach the corrugated sheet metal part 540 also seals the upper and lower channels for the cooling and drying air. In this way, the drying air 533 that, after passing through the defluff filter, enters the air-air heat exchanger and flows under the corrugated sheet metal part 540, releases heat to the cooling air 555 that flows above the corrugated sheet metal part 540, and cools down, and the moisture present therein is condensed. The cooling air 555, after passing through the air-air heat exchanger, exits from the front thereof, and is then discharged into the machine cabinet 110 through an aperture 570 provided in the base element 505. In alternative to the tangential fan 560, an axial fan might be provided in correspondence of the aperture 570 for circulating the cooling air.

After passing through the air-air heat exchanger 535, the cooled drying air 573 exits it from the right rear corner thereof, and then flows along a convoluted air path portion 575 to the opening 515 that is connected to the fan intake 210. Along the convoluted air path portion 575, mist/condense water droplets separation means are provided, for ensuring that mist, condense water droplets are removed from the drying air before it reaches the air fan 205.

Figure 9:
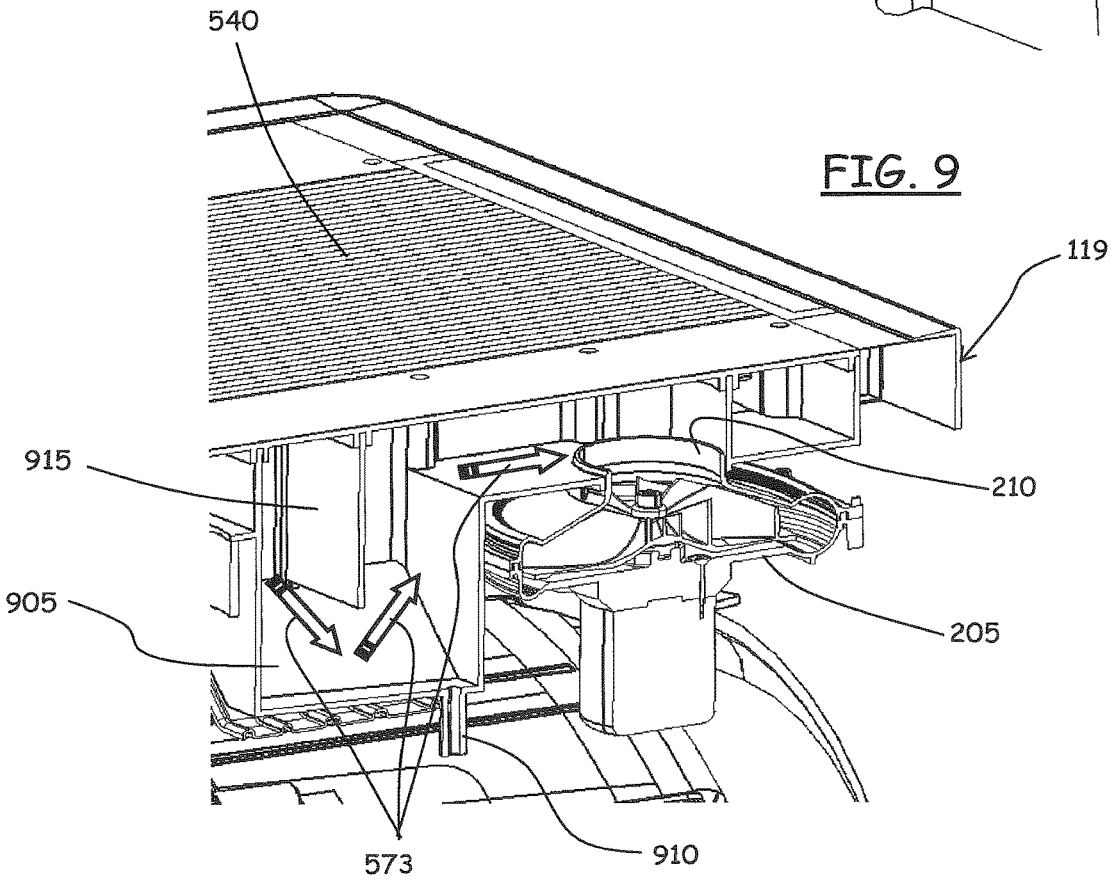
FIG. 9 shows still another detail of the worktop of FIG. 5A, particularly an embodiment of mist separation means provided in the worktop.

As visible in FIG. 9, in an embodiment of the invention, the mist/condense water droplets separation means comprises a condense water collecting tank 905 formed along the convoluted air path portion 575; droplets of condense water released by the drying air upon passing through the air-air heat exchanger are drawn by the aspiration effect of the fan 205 to the convoluted air path portion 575 and arrives at the tank 905, where they are separated from the drying air and accumulate. At the bottom of the tank 905, a condense water discharge conduit 910 is fluidly connected to the manifold 315, by means of a piping 1005, visible in FIG. 10. In particular, the piping 1005 that connects the condense water discharge conduit 910 to the manifold 315 opens into the latter at a point below the free surface of the water that remains in the siphon defined by the baffle 405; in this way, it is ensured that the condense water is not aspirated by the fan 205. When, due to the discharged condense water, the level of water in the manifold 315 raises excessively, the excess water is discharged into the tub 303, in a position thereof such that the water does not enter the drum, but is instead directly conveyed, via the tub, to a liquid discharge circuit, comprising a discharge pump, provided in the washer/dryer.

As an alternative to discharging the condense water into the manifold 315, the condense water that accumulates in the tank 905 may be directly conveyed to the water discharge pump.

Figure 11:
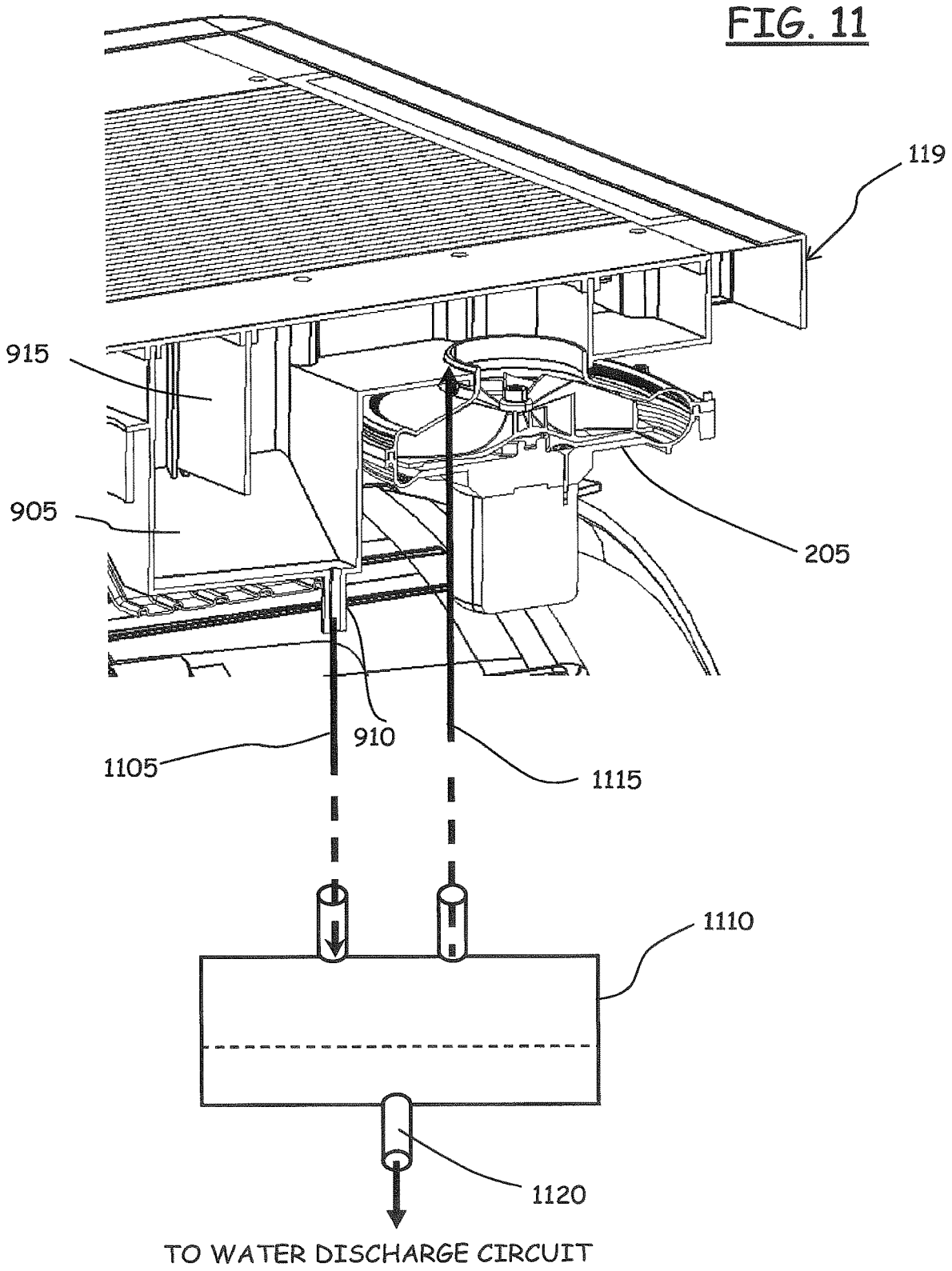
FIG. 11 schematically shows a detail of an alternative embodiment of the mist separation means of FIG. 9.
Figure 17:
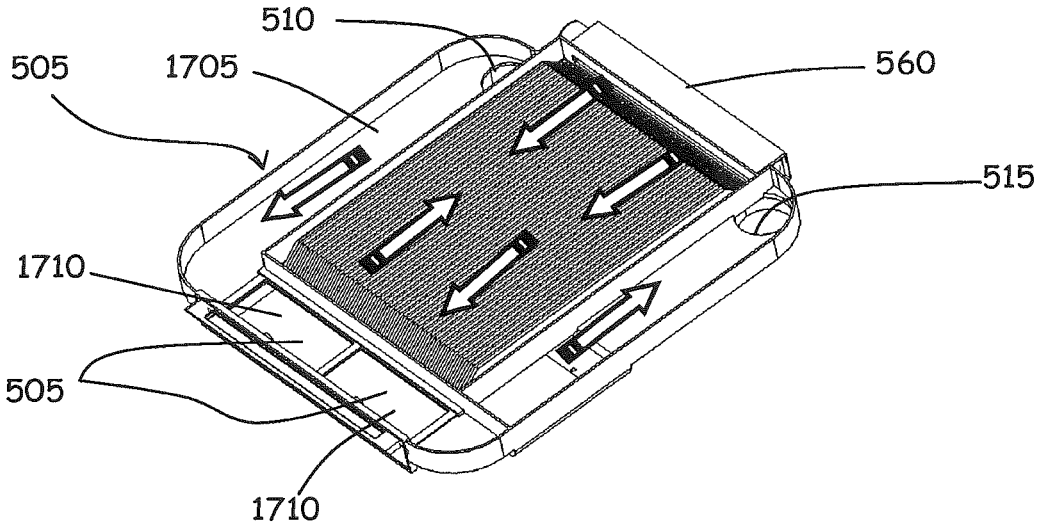
FIGS. 17 and 18 show an alternative construction of the worktop of FIG. 5A.
Figure 18:
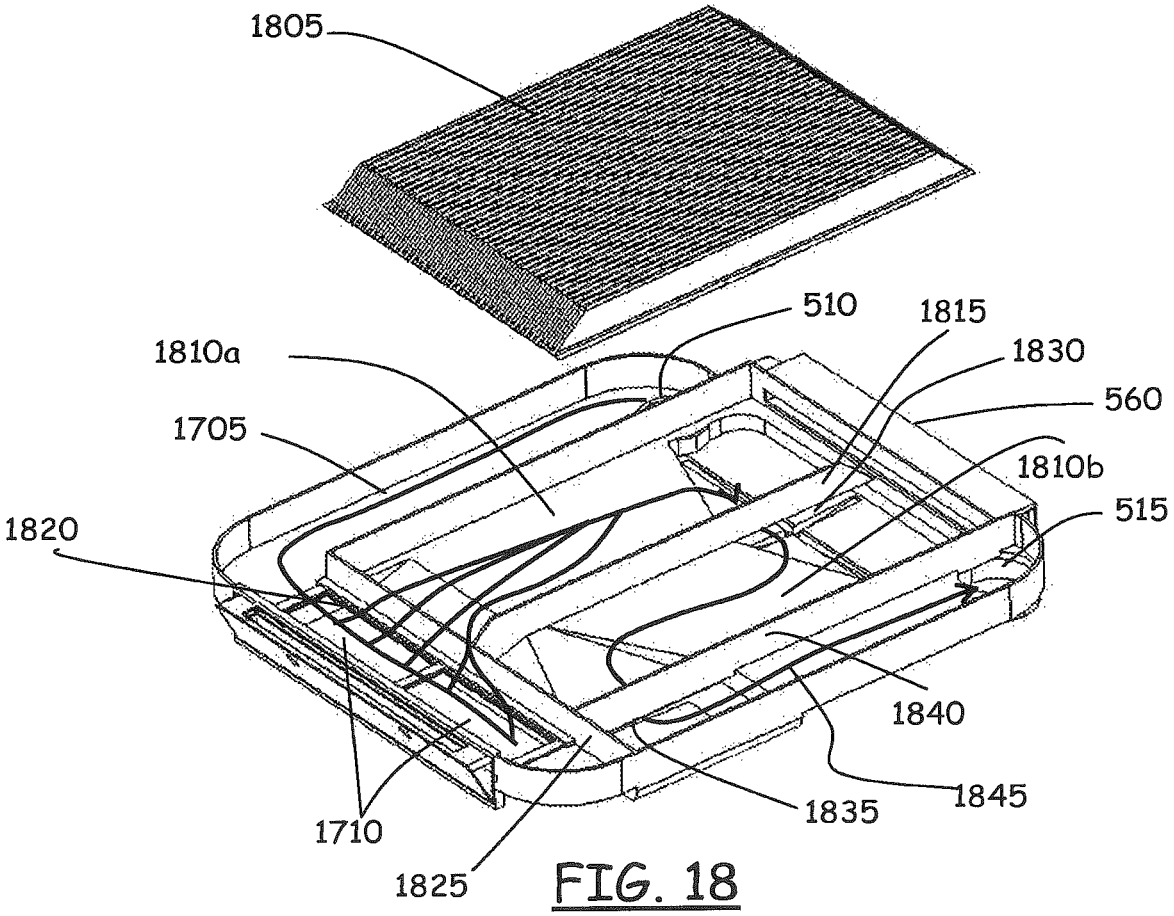

Preferably, as schematically depicted in FIG. 11, in order to avoid that the depression generated by the fan 205 may suck condense water that deposits in the tank 905, the discharge conduit 910 of the tank 905 is fluidly connected, by a conduit 1105, to a lower tank 1110, located at a suitable lower quota with respect to the top 119, for example at or near the basement of the washer/dryer. The lower tank 1110 is further fluidly connected, through a conduit 1115, to a point of the convoluted air path portion 575 located downstream the tank 905, for example close to the air intake 210 of the fan 205. The bottom of the lower tank 1110 has a condense water discharge outlet 1120 that is fluidly connected to the water discharge circuit of the washer/dryer, and thus to the discharge pump.

A baffle 915 is preferably provided in the tank 905, the baffle 915 defining a siphon; the presence of the baffle 915, forming as barrier for the drying air flow, facilitates that water droplets that are transported by the flow of drying air fall into the tank 905, preventing them from reaching the fan 205.

As an alternative to the provision of the baffle 915 shown in FIGS. 9 and 11, a mist separator element 1205 may be accommodated in the tank 905, as depicted in FIG. 12, for promoting the removal of moist droplets from the drying air. The mist separator element 1205 may for example be formed of a plurality of metal or plastic plates bent to define a winding path. Also in this case, the lower tank 1110 may be provided.

Figure 7A:
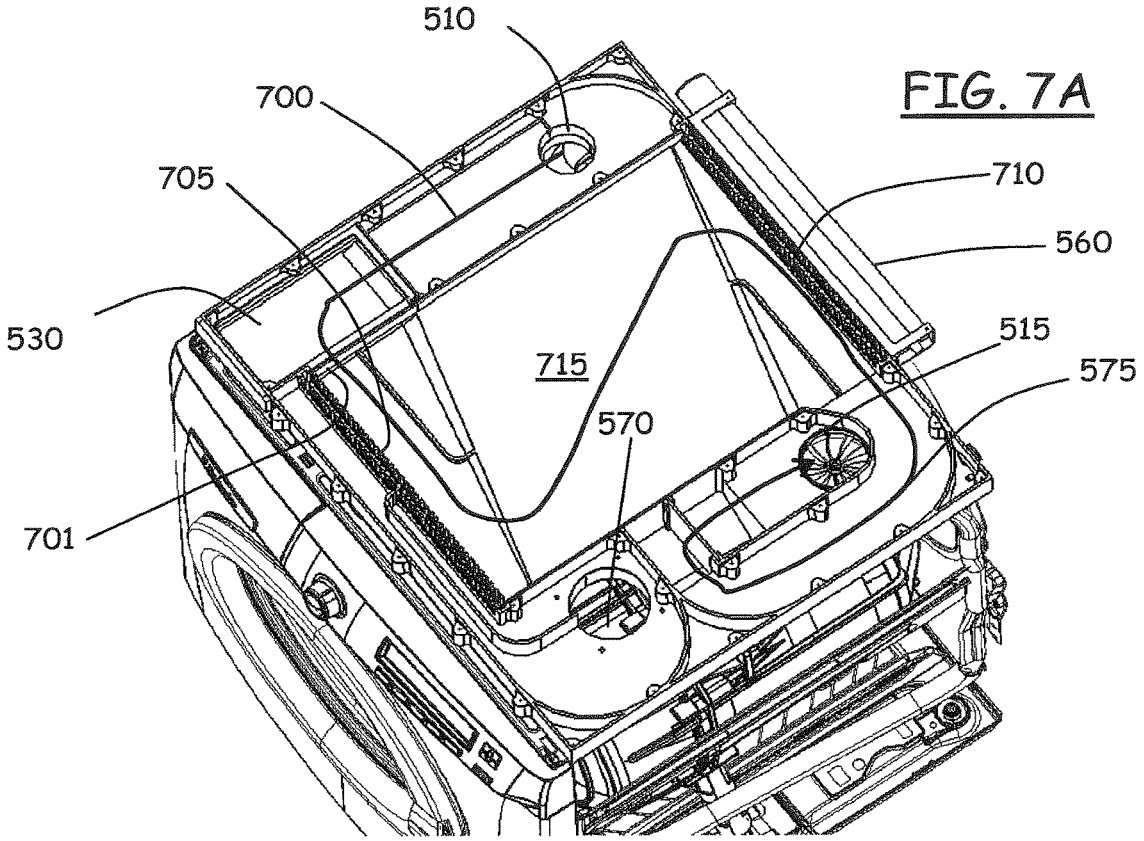
FIGS. 7A and 7B schematize the path followed within the worktop of FIG. 5A by laundry drying air to be dehydrated, and by cooling air used to cool down the drying air so as to remove moisture therefrom.
Figure 7B:
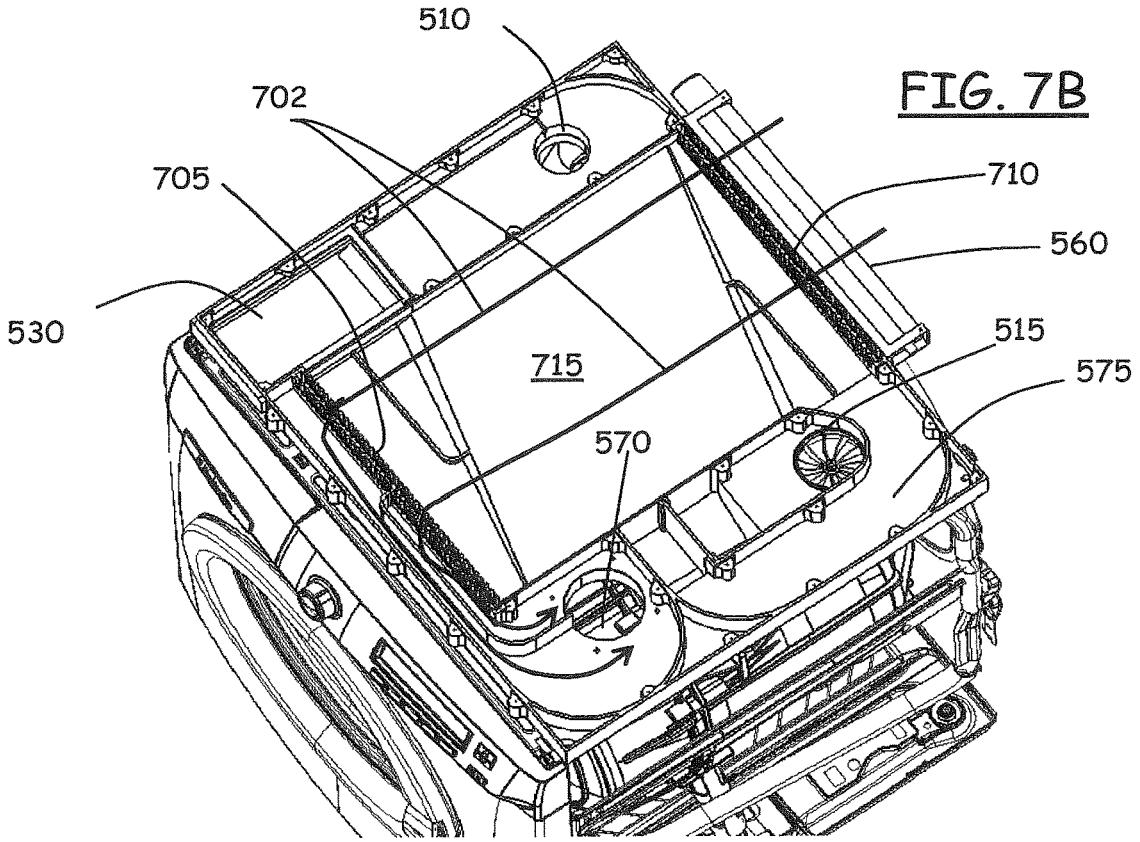
Figure 8:
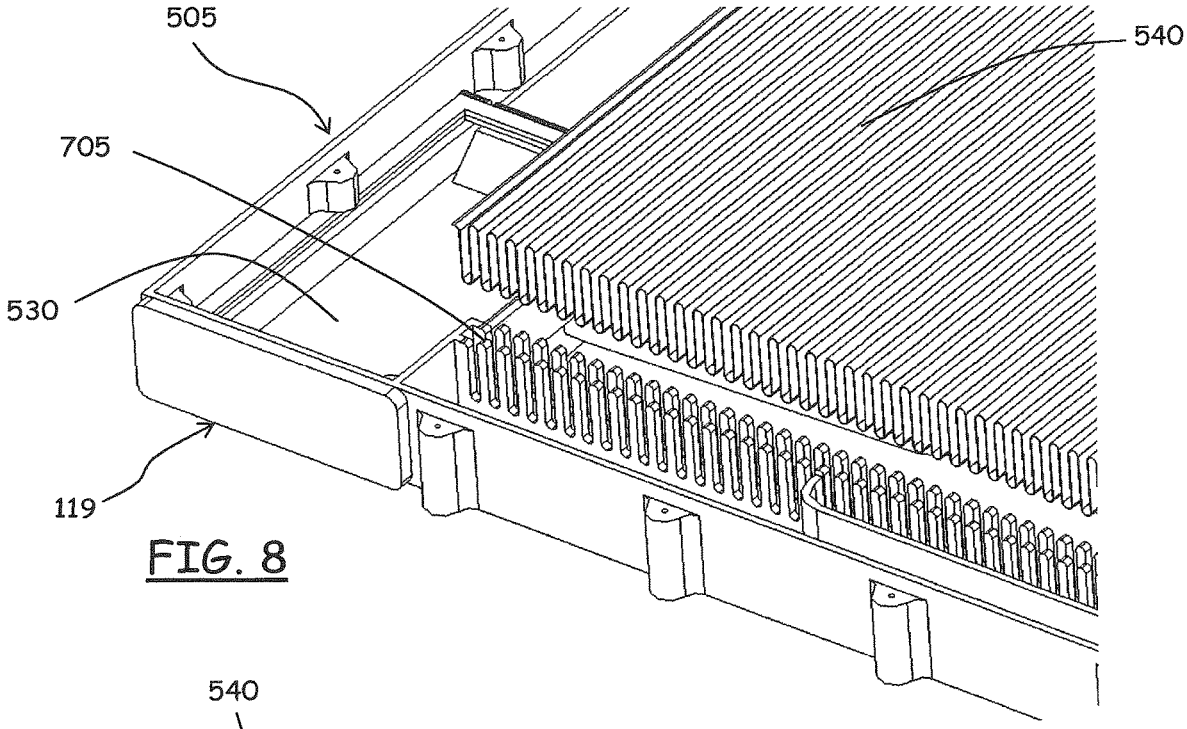
FIG. 8 shows another detail of the worktop of FIG. 5A.

The path followed in the top 119 by the moisten-laden drying air is also schematized in FIG. 7A, and indicated therein as 700. The drying air passes through the defluff filter vertically, from the top to the bottom filter surfaces, and exits the filter seat 530 (for then entering into the air-air heat exchanger) passing through an opening 701 formed along a bottom of a side wall of the filter seat 530. In FIG. 7B, there is instead schematized (reference 702) the path followed by the cooling air.

The condense water that accumulates in the tank 905 may be exploited for generating steam used for refreshing the items to be dried during the drying cycle. As schematized in FIGS. 13 and 14A, the tank 905 may be shaped so as to have a deeper portion 1305, defining a reservoir for water used to generate steam. A pump 1310 has an inlet connected to the tank deeper portion 1305; the pump 1310 has an outlet fluidly connected to a nozzle 1405 arranged to spray inside the air duct 215, preferably in a point thereof where there is the electrical resistor provided for heating the drying air; in this way, the heat generated by the resistor cause the water sprayed by the pump 1305 to vaporize, and steam is generated that is useful for refreshing the items being dried. The resistor may be mounted internally or externally to the air duct 215; in case the resistor is mounted within the air duct 215, an armoured resistor should be used. For a more efficient operation, as depicted in FIG. 15, the drying air heating resistor 1505 may be associated with a heat dissipater/radiator 1510 having fins, that is accommodated within the air duct 215. In this way, the effect of drying air heating and of vaporisation of the water sprayed by the pump 1310 is enhanced.

Figure 14B:
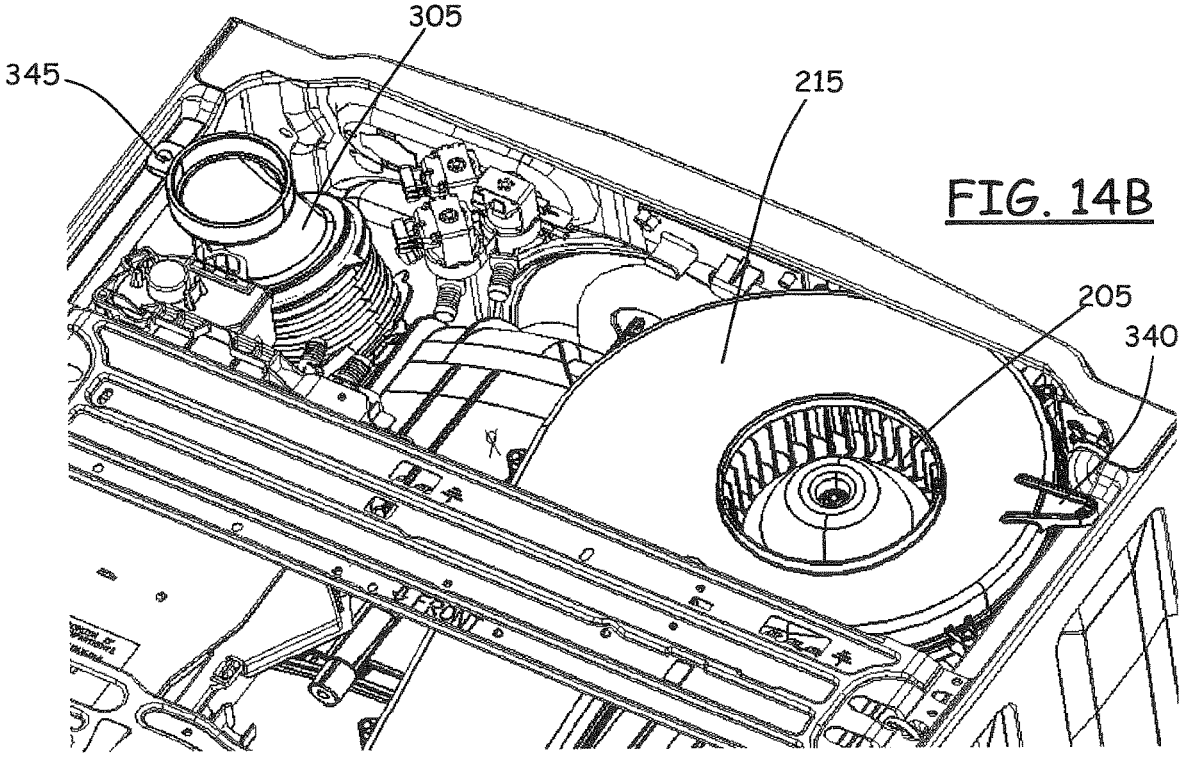
FIG. 14B shows a detail of the fixation of the drying air circulation fan of FIG. 14A to the machine cabinet.

In FIGS. 14A and 14B there is also shown a variant of the construction of the fan 205 and air duct 215, in which the air duct 215 is shaped so as to also define a housing for the fan 205; the air duct is made of two half-shells, and is preferably fixedly, rigidly mounted to the cabinet 110 by means of the bracket 340, as visible in FIG. 14B.

Referring back to FIG. 5A, a pair of panels 580 and 585 are provided in the top 119 for closing from above the air path defined in the base element 505 for the drying air. The top 119 is completed by a further panel 590, having also aesthetic function, that is superimposed to the two panels 580 and 585 and that also covers the corrugated sheet metal plate 540, and by a frame 595 (the panel 590 and the frame 595 are not depicted in FIG. 2). The panels 580, 585 and 590 are secured to the base element 505 for example by means of screws.

Figure 16:
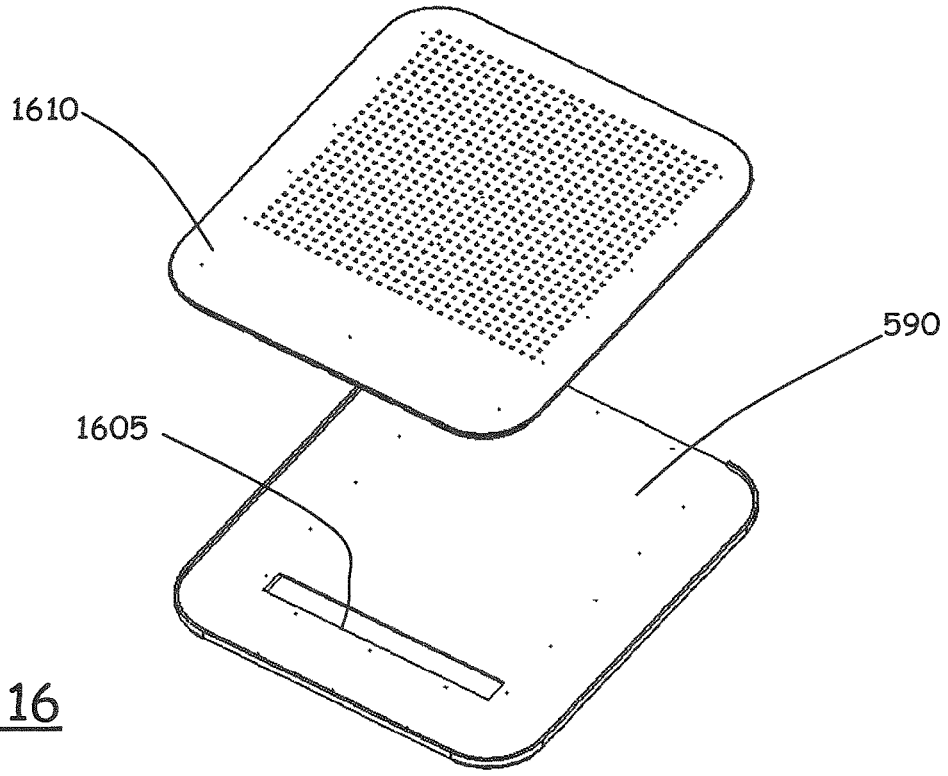
FIG. 16 shows schematically an embodiment of the worktop of FIG. 5A adapted to define a drying surface for laying garments to be dried gently.
Figure 5A:
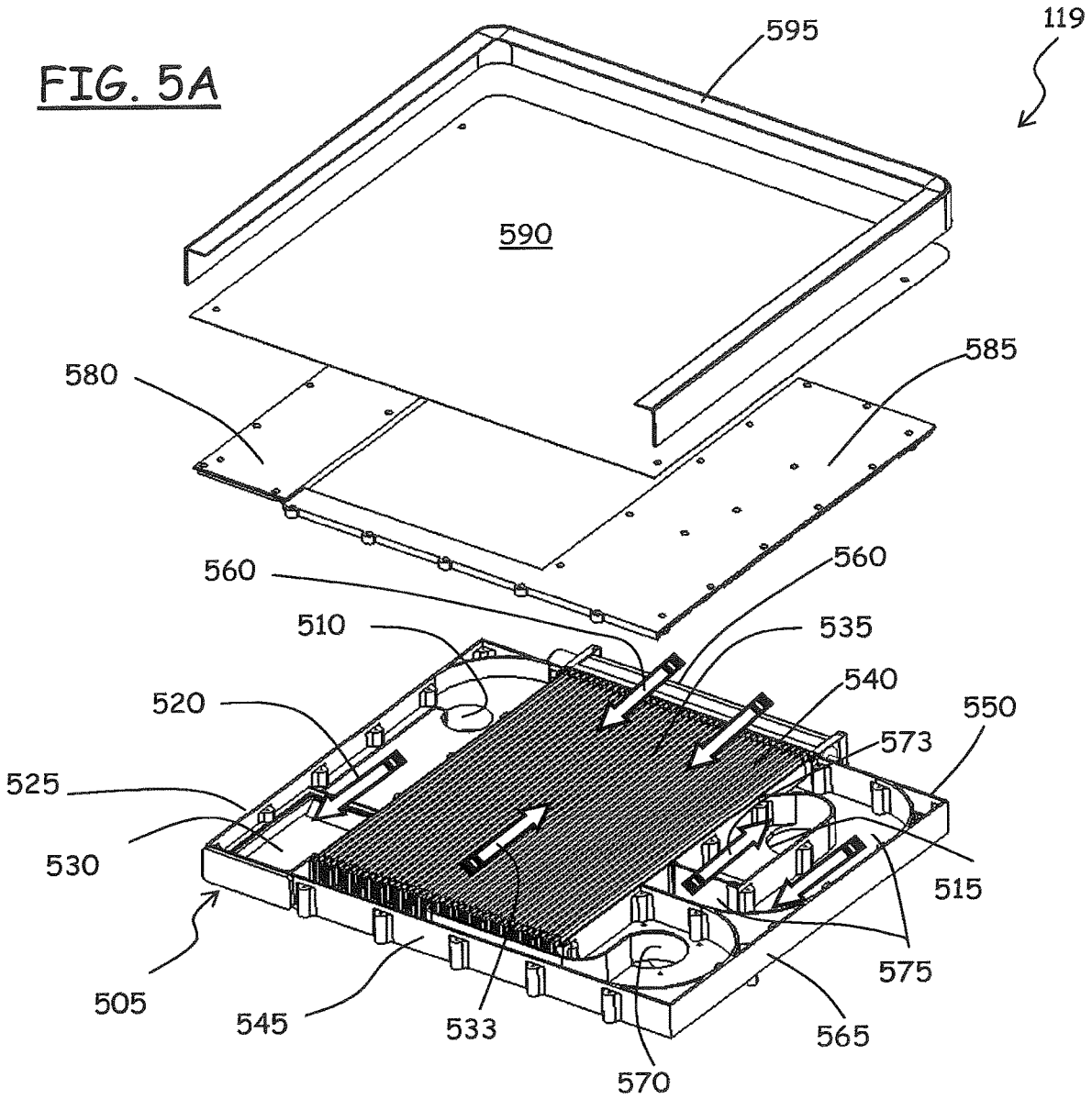
FIG. 5A shows in perspective exploded view a worktop of the appliance of FIG. 2, in an embodiment of the present invention.
Figure 6:
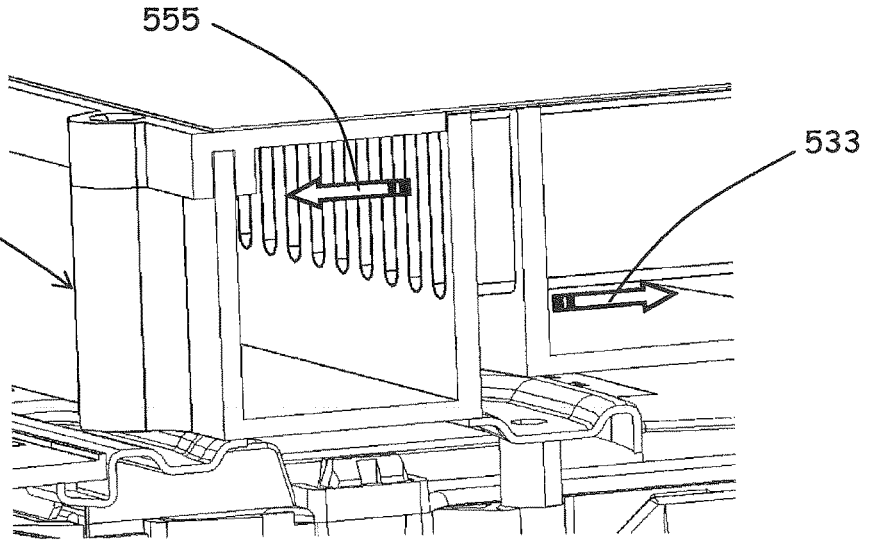
FIG. 6 shows a detail of the worktop of FIG. 5A.
Figure 5B:
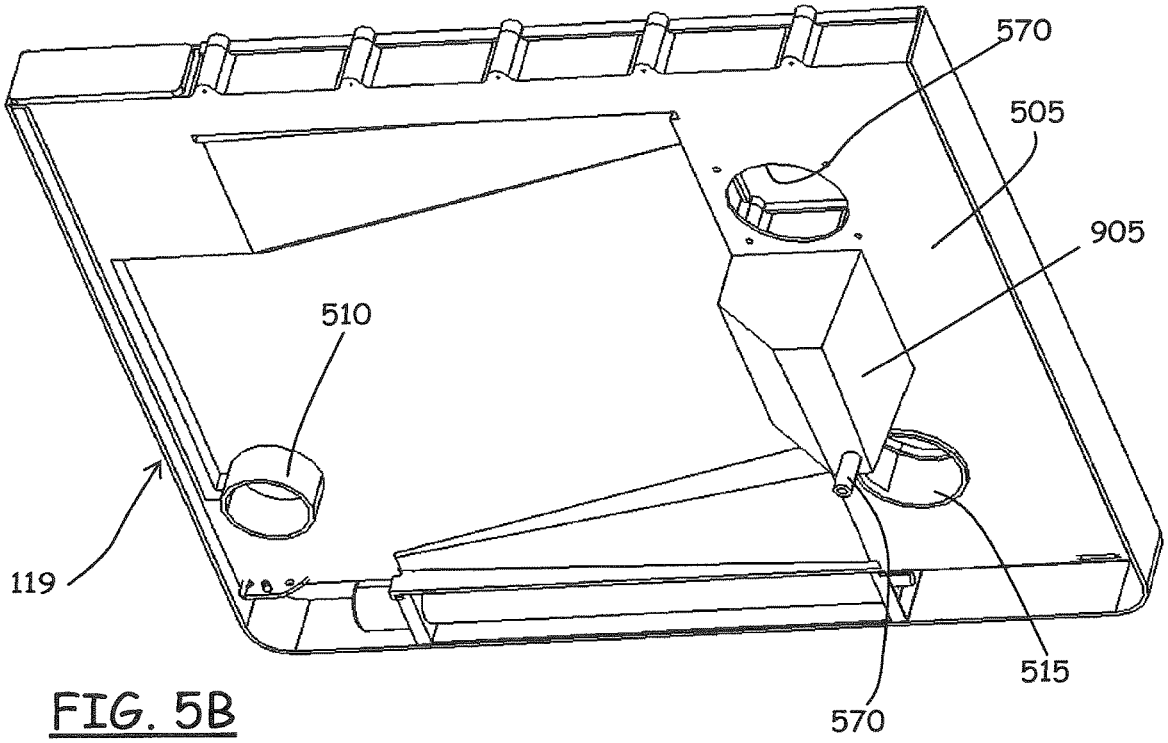
FIG. 5B shows the worktop of FIG. 5A from below.

In an embodiment of the present invention, shown in FIG. 16 (and similarly in FIGS. 19 and 20, although the latter drawings relate to a variant of the top here described, that will be described later on), the panel 590 has an elongated aperture 1605 extending parallelly to the front of the top 119, from which opening 1605 the cooling air 555, after having passed through the air-air heat exchanger 535, exits. Above the panel 590, a perforated panel 1610 rests, slightly spaced apart from the panel 590, so as to leave an air gap between the two panels 590 and 1610. The cooling air 555, heated by the heat released by the drying air 533, exits from the perforations in the panel 1610. In this way, the top 119 may be exploited for laying thereon delicate garments to be dried that, due to their nature, cannot be dried within the tumbling drum without being damaged. The top 119 thus defines thereinside a path for the drying air to be cooled down, and another path for the cooling air which is also exploited for drying delicate garments by laying them on the perforated surface of the panel 1610.

The top 119, once assembled, forms a unit that is ready to be mounted to the cabinet 110, simply by placing it in the correct alignment, so that the openings 510 and 515 matches the outlet 310 of the return air duct 305 and, respectively, the intake 210 of the air circulation fan 205. As mentioned in the foregoing, both the return air duct 305 and the fan 205 are preferably fixed, rigidly connected to the machine cabinet 110; in this way, the outlet 310 of the return air duct 305 and the air intake 210 of the air circulation fan 205 act as automatic positioning and centering means for the top 119, thereby greatly simplifying the mounting thereof. The operation of mounting of the top onto the cabinet simply consists in laying the top 119 on the cabinet properly positioning it with the help of the self-centering action achieved by the matching of the openings 510 and 515 with the outlet 310 and air intake 210; in this way, all the necessary connections for the drying air circulation circuit are completed, and there is no necessity to perform any additional connection (exception made for the connection of the condense water discharge piping 1005). The top 119 may then be secured to the cabinet 110 by conventional means. Thanks to the fact that several components of the drying air circulation system, particularly the moisture condensing system, are accommodated within the top 119, several problems of space within the cabinet 110 are overcome; essentially, only the fan 205, the air duct 215, and the return air duct 305 need to be accommodated within the cabinet 110. This reduces problems of space within the cabinet 110, and makes it easier to exploit an already existing design of a washing machine to transform it into a washer/dryer, without having to make substantial changes.

Figure 19:
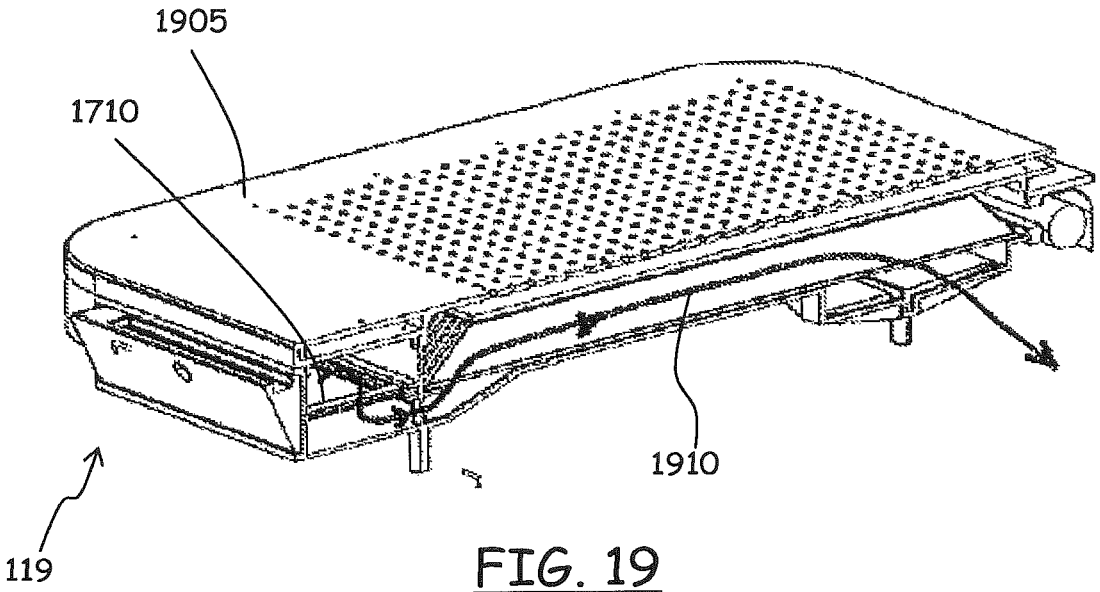
FIGS. 19 and 20 show the implementation of the concept of FIG. 16 to the alternative worktop construction of FIGS. 17 and 18.
Figure 20:
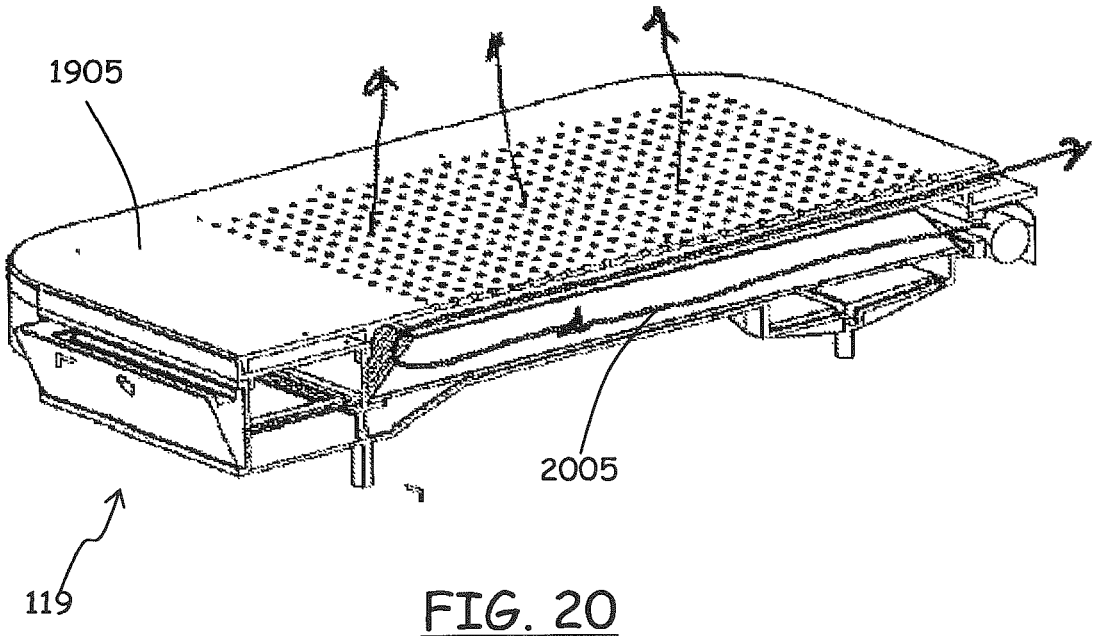
Figure 21:
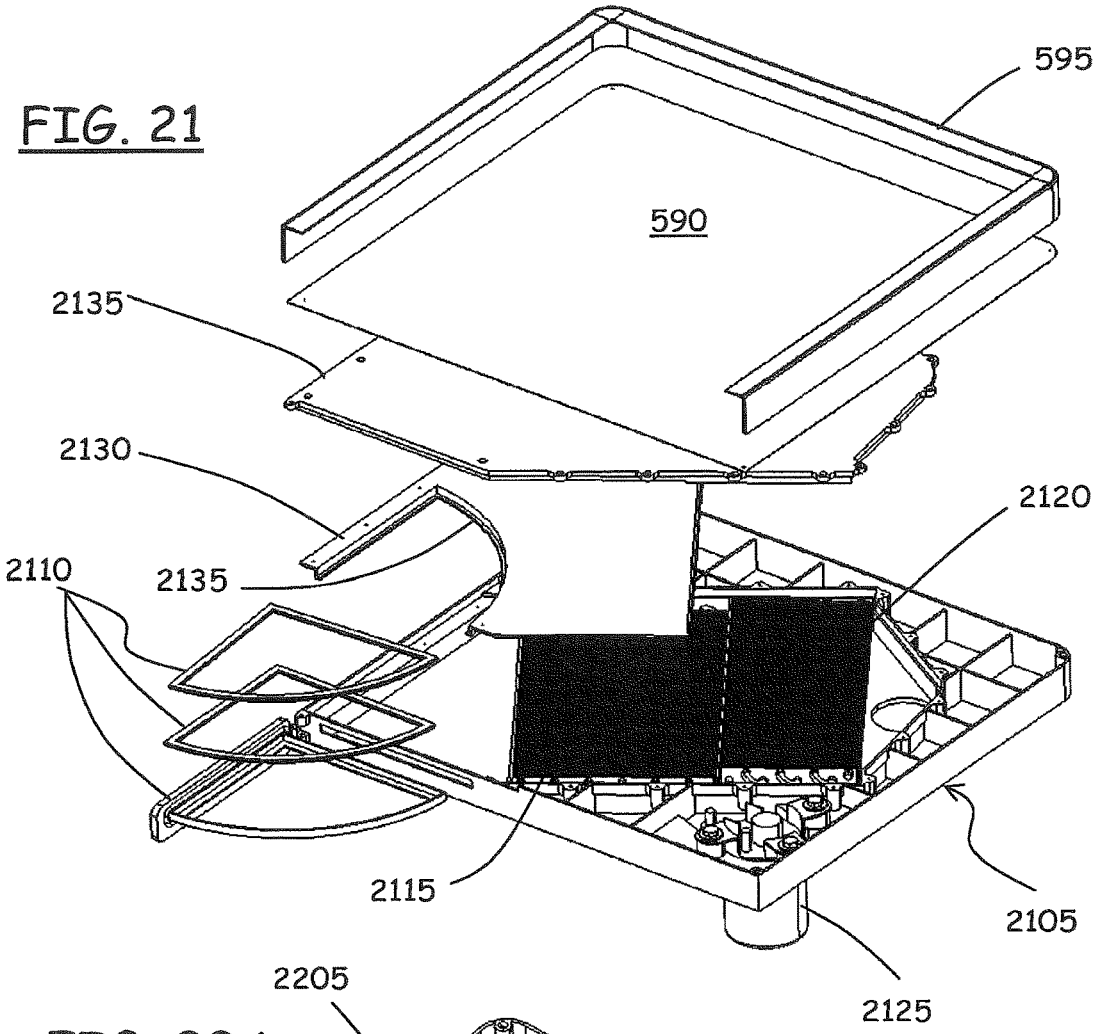
FIG. 21 shows in exploded view a worktop according to another embodiment of the present invention, comprising a heat pump for dehydrating and then heating the drying air.
Figure 22A:
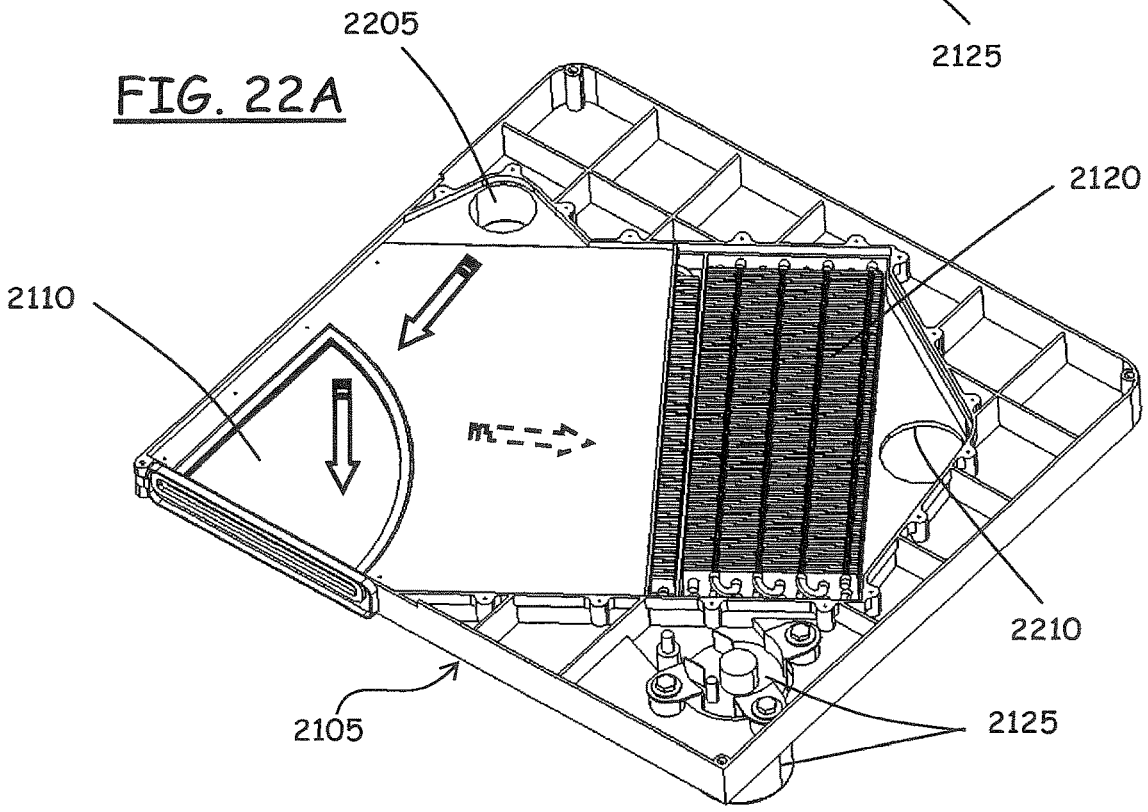
FIG. 22A shows the worktop of FIG. 21 partially mounted, and schematizes the path followed by the drying air.
Figure 22B:
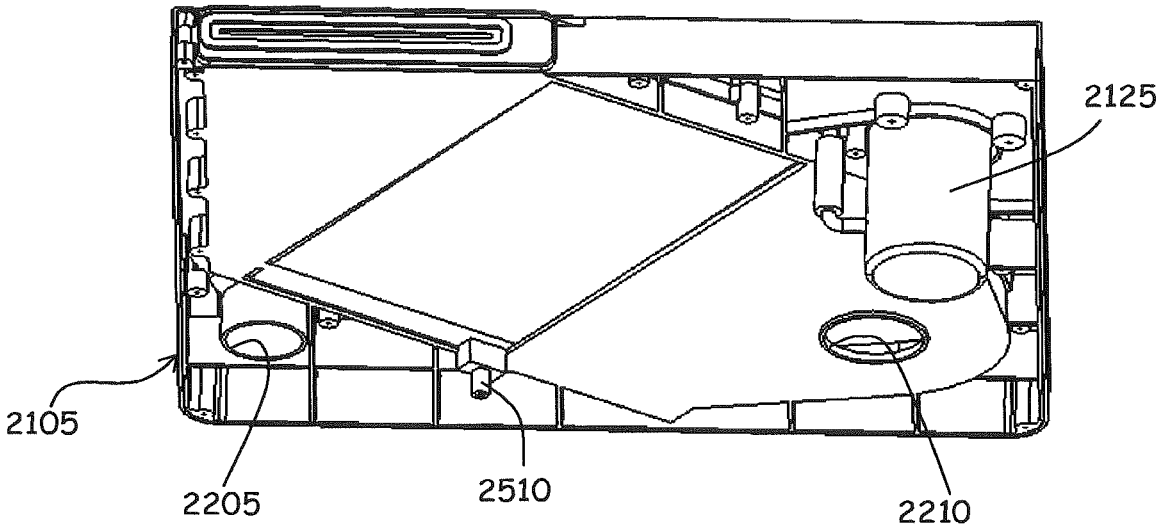
FIG. 22B shows the worktop of FIG. 22A from below.
Figure 24B:
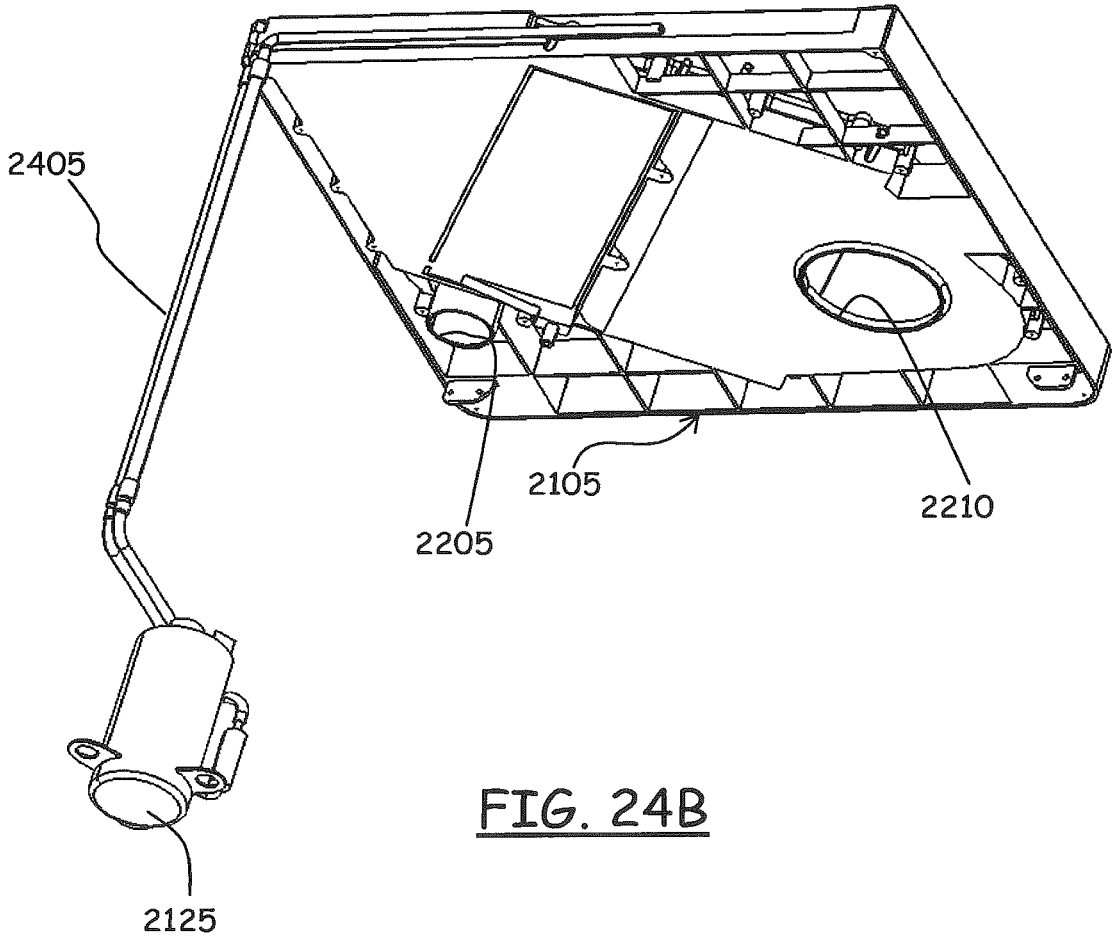
FIG. 24B shows from below the worktop and compressor in the variant of FIG. 24A.
Figure 23:
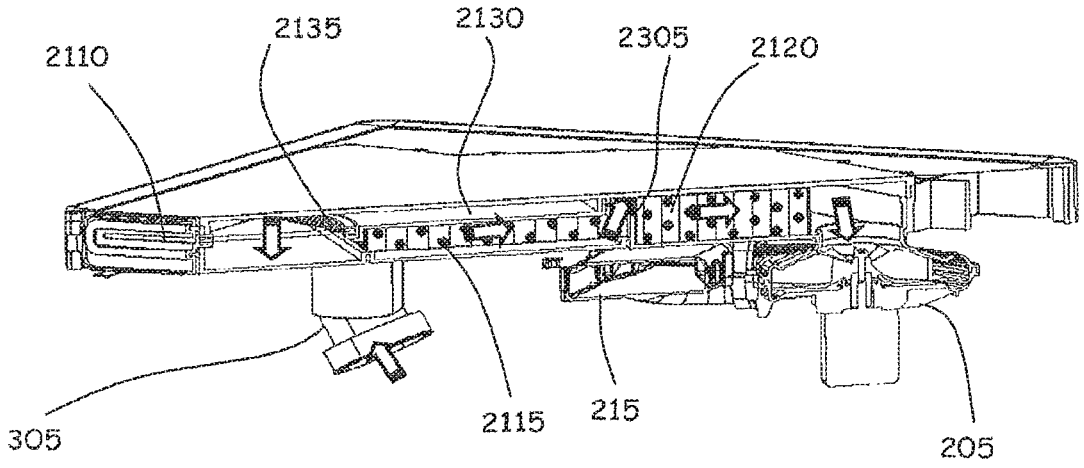
FIG. 23 shows the worktop of FIG. 21 partially sectioned, and also schematizes the path followed by the drying air.
Figure 24A:
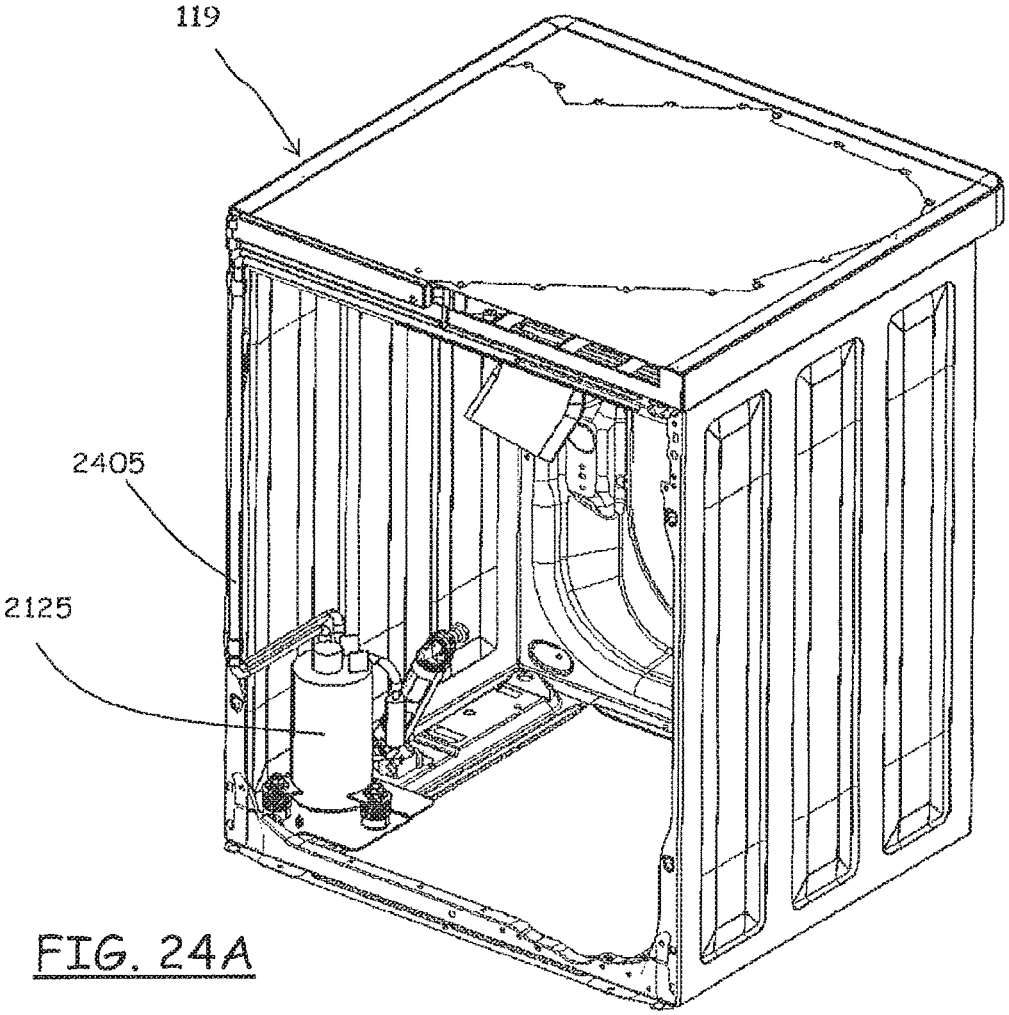
FIG. 24A shows a variant of the solution of FIGS. 22A and 22B, with a compressor accommodated in the basement of the machine.
Figure 25:
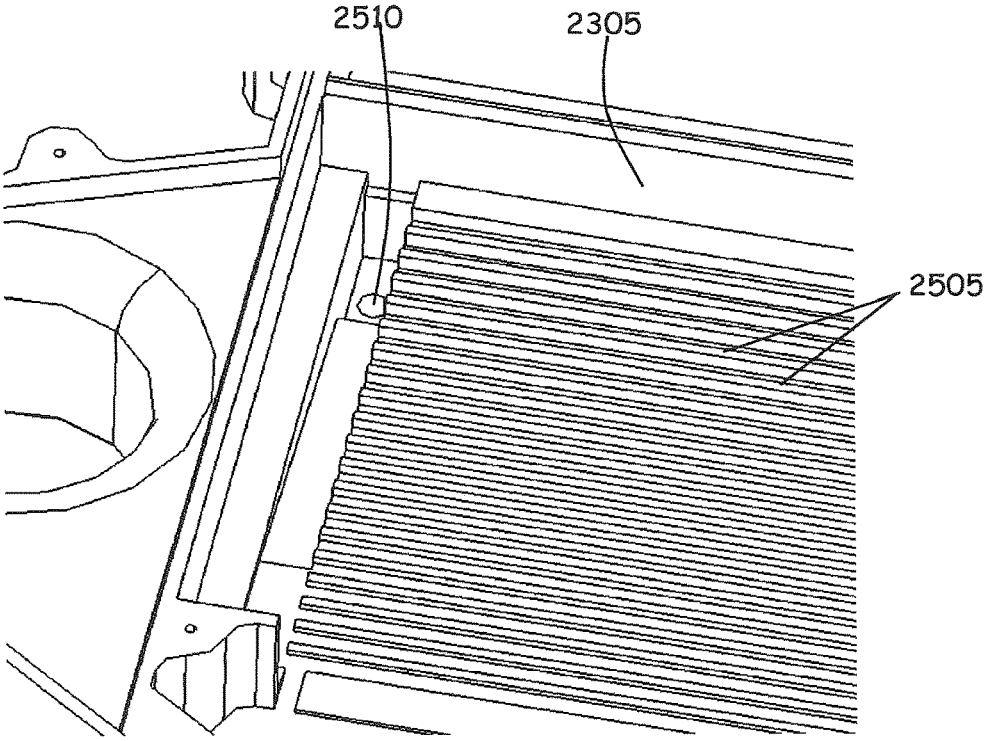
FIG. 25 shows a detail of the worktop of FIG. 21.
Figure 26:
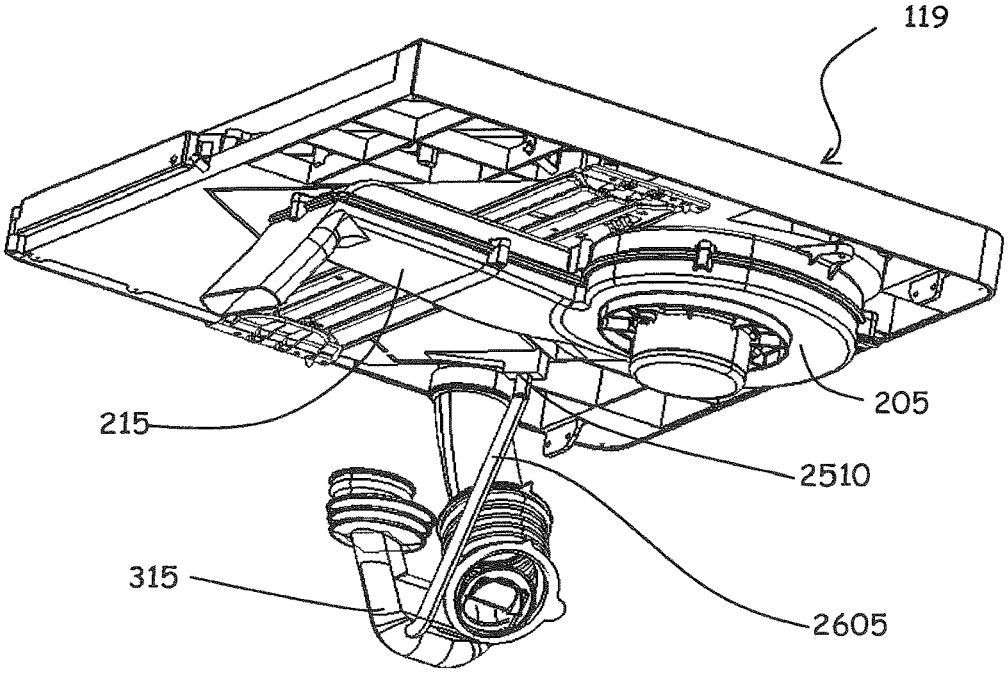
FIG. 26 shows an arrangement for draining condense water from the worktop of FIG. 25.

A top 119 according to a variant of the embodiment just described is depicted in FIGS. 17-20. In this case, the drying air to be cooled down for releasing the moisture and being dehydrated passes through the air-air heat exchanger twice, once going from the front towards the rear, and then back towards the front, as schematized in FIG. 18. This double passage improves the action of cooling of the drying air by the cooling air, and thus improves the release of moisture. In particular, the drying air, entering into the top 119 through the opening 510, flows along a substantially rectilinear path 1705 defined in the base element along the left side thereof, from the back to the front, and then enters a defluff filter 1710, which in this alternative is accommodated along the front side of the base element 505. The drying air passes through the defluff filter (from the top to the bottom thereof), and then enters the air-air heat exchanger. As in the previously described embodiment, the air-air heat exchanger comprises a corrugated sheet metal part 1805, the undulations defining channels for the passage of the drying air (under the corrugated sheet metal part 1805) and for the cooling air (above the corrugated sheet metal part 1805). The region of the base element 505 destined to accommodating the corrugated sheet metal part 1805 is divided in two parts 1810*a*, 1810*b*, separated by a wall 1815 extending parallely to the side walls of the base element 505. The drying air passes from the filter to the air-air heat exchanger flowing through a passage 1820 formed at the bottom of a wall 1825 that separates the filter lodging from the region of the air-air heat exchanger, said passage being located on the left side of the base element. The drying air flows under the corrugated sheet metal part 1805 in the first part 1810*a* of the base element 505, then, at the rear of the base element 505, the drying air passes to the second part 1810*b* of the base element passing through a passage 1830 formed at the bottom of the wall 1815. The drying air then flows under the corrugated sheet metal part 1805 in the second part 1810*b* of the base element 505 to the front, and exits the air-air heat exchanger passing through an aperture 1835 below a lateral wall 1840 of the base element 505 that delimits the region thereof accommodating the corrugated sheet metal part 1805. The cooled drying air thus exits the air-air heat exchanger from the front-right corner thereof, then the drying air flows along an essentially straight air path 1845 towards the opening 515, where there is the intake 210 of the fan 205. For the discharge of the condense water that is released by the drying air, solutions similar to those described above are exploitable. As shown in FIGS. 19 and 20. the top panel 1905 of the top 119 may also in this case be perforated, for the passage of the cooling air, so as to provide a working surface for lying delicate garments that are not suitable to be dried by putting them into the tumbling drum of the machine. The top 119 defines thereinside a path for the drying air 1910 to be cooled down, and another path for the cooling air 2005 which is also exploited for drying delicate garments by laying them on the perforated surface of the panel 1905.

FIGS. 21 to 26 show, in different views, a solution according to a second embodiment of the present invention, in which the condensing system is almost completely accommodated within the top 119 and comprises, as mentioned, a heat pump, instead of an air-air heat exchanger.

Also in this case, the top 119 comprises a base element 2105, which has two openings 2205 and 2210, the former in correspondence of the outlet 310 of the return air duct 305, the latter in correspondence of the intake 210 of the fan 205. In the region of the base element 2105 near the front-left corner thereof, a defluff filter arrangement 2110 is located, for example in the form of a drawer hinged at one end to the base element 2105 and pivotable so as to allow its extraction for cleaning purposes. The defluff filter may comprises a couple of superimposed meshes that can be separated for being cleaned.

In the central region of the base element 2105, there is accommodated a moisture condensing system comprising an evaporator 2115 part of a heat pump that further comprises a condenser 2120. The evaporator 2115 has the function of dehydrating the drying air, by cooling it down; the condenser 2120 has instead the function of heating the dehydrated drying air. A compressor 2125 for the heat pump is attached to the base element 1405 in correspondence of the front-right corner thereof, the compressor body protruding from below the base element 2105. In an alternative embodiment, shown in FIGS. 24A and 24B, the compressor 2125 may be located in the bottom of the cabinet, attached to the basement, and be fluidly connected to the moisture condensing system accommodated in the top 119 by means of flexible pipes 2405 than run along a rear corner of the cabinet 110.

The base element 2105 is covered by a first panel 2130, that covers essentially just the evaporator 2115, and a second panel 2135, that also covers the condenser 2120 and the filter 2110. The top 119 is completed by the top panel 590 and the frame 595. The base element 2105 and the two panels 2115 and 2135 define a first air path that conveys the drying air coming from the return air duct 305 to the defluff filter, preventing the drying air from entering the evaporator, and a second air path that, from the defluff filter, goes to the condenser passing through the evaporator.

The drying air passes through the filter 2110 from the top to the bottom of it, and then enters the evaporator 2115. The panel 2130 has, along an edge thereof that runs along the border between the filter 210 region and the evaporator 2115 region, a downwardly projecting lip 2135 that prevents the drying air to enter the evaporator region from above the filter 2110.

In the region of the base element 2105 under the evaporator 2115, there are provided mist/condense water droplets separation means; in particular, the base element 2105 is slanted towards a baffle 2305 that separates the area of the base element 2105 where the evaporator 2115 is accommodated, from the area where the condenser 2120 is placed. The baffle 2305 forms a barrier for the condense water that drops from the drying air when it passes through the evaporator 2115. Preferably, transversal channels 2505 are formed in the base element in the area corresponding to the evaporator 2115, to facilitate the drainage of the condense water. A condense water drainage hole 2510 is formed in the area of the base element corresponding to the evaporator 2115; the drainage hole 2510 is fluidly connected, through a conduit 2605, to the manifold 315, for discharging the condense water. The conduit 2605 opens into the manifold 315 at a point below the surface of the water that remains in the manifold 315, for avoiding that, due to the depression created by the fan 205, the condense water is aspirated back. Also in this case, the excess condense water that accumulates in the manifold 315 discharges into the tub, in a manner such as not to enter into the drum, and then goes to the water discharge circuit of the machine. Alternatively the drainage hole 2510 may be fluidly connected to the water discharge circuit directly.

Also in this second embodiment, the top 119, once assembled, forms a unit that is ready to be mounted to the cabinet 110, simply by placing it in the correct alignment, so that the openings 2205 and 2210 matches the outlet 310 of the return air duct 305 and, respectively, the intake 210 of the fan 205. The top 119 may then be secured to the cabinet 110 by conventional means. No further connections need to be made, exception made for the connection of the drainage hole 2510 to the manifold 315; in the variant having the compressor located in the basement, the top 119 may be preassembled with the pipes 2405 attached to the heat pump; after placing the top on the cabinet, the pipes 2405 are connected to the compressor.

The solution exploiting an air-air-heat exchanger as a condensing means for removing moisture from the drying air achieves a significant saving of water compared to the solutions known in the art exploiting a water spray condenser; in fact, water spray condensers waste several liters of waters, that is taken in from the water main.

The solution exploiting the heat pump, in addition to achieving a saving of water as that exploiting the air-air-heat exchanger, also allows saving electrical energy, because the electrical resistor for heating the drying air may be dispensed with; in any case, nothing prevent from providing also in this embodiment the resistor air heater: for example, it may be useful for the starting phases of the drying cycle, where the condenser in the heat pump is not yet reached the full working temperature, or for the generation of steam for refreshing the items being dried, as in the solution described above.

Figure 27:
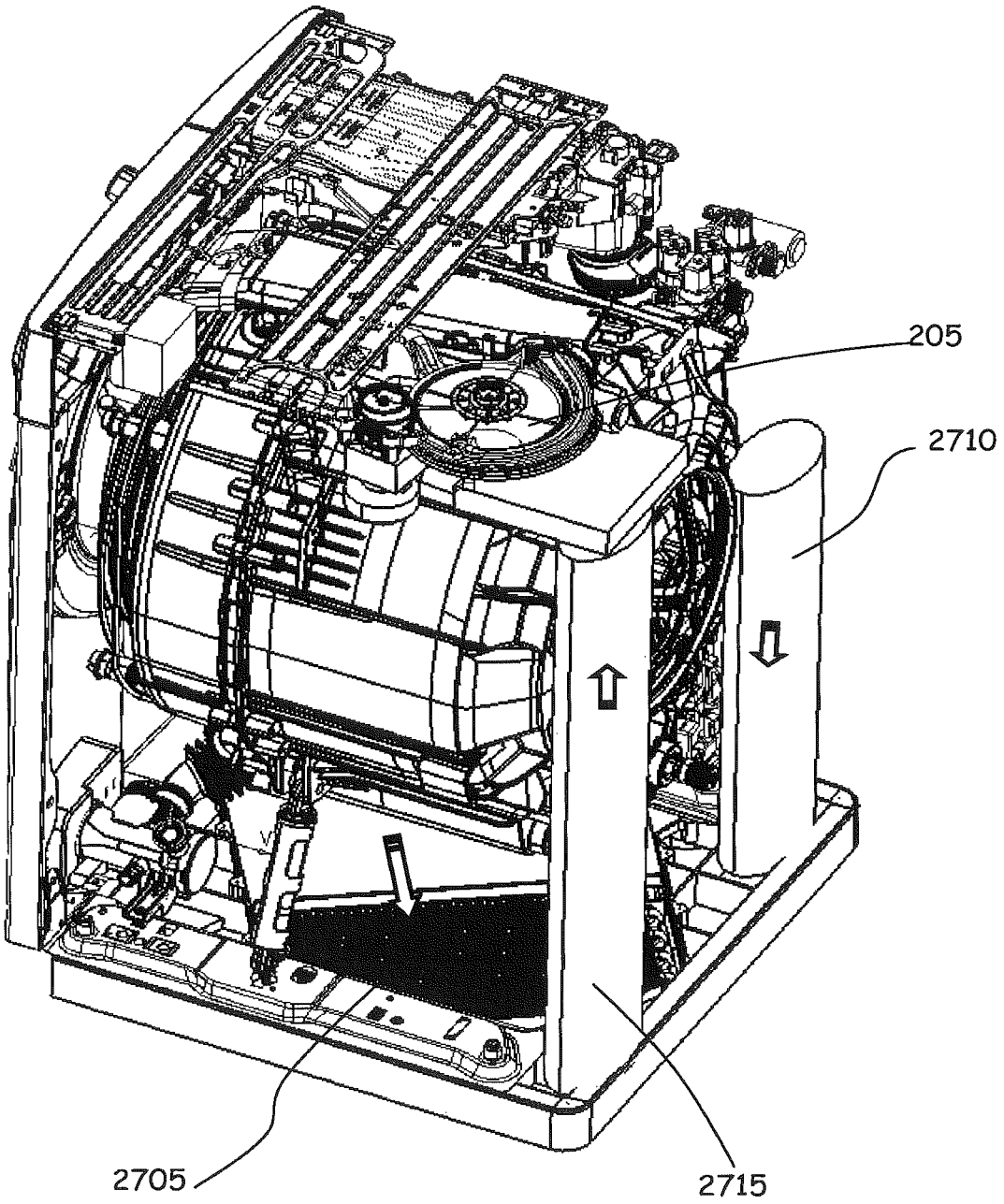
FIG. 27 shows a variant of the solution of FIGS. 21 to 26, with the heat pump accommodated in the basement of the appliance.

Finally, in FIG. 27 there is shown a variant of the heat pump solution in which the heat pump 2705, instead of being accommodated within the top 119, is placed at the base of the cabinet (also the compressor being in this accommodated in the bottom of the machine); air ducts 2710 and 2715 extending along the rear wall of the cabinet are provided for conveying the drying air exiting the drum to the heat pump, and for conveying back the demoisturized drying air to an air intake of the air circulation fan 205. Also in this case, the heat pump may be realized in the form of an assembly ready to be mounted.

Several modifications to the embodiments described in the foregoing can be envisaged.

For example, the rotary defluff filter described in connection with the second embodiment could be implemented as well in the first embodiment.

The invention claimed is:

1. A laundry drying appliance comprising a cabinet, a top above the cabinet, a rotating drum accommodated within a tub housed in the cabinet, and a laundry drying air circulation system for circulating drying air, wherein:

the drying air circulation system comprises a drying air return duct through which drying air coming from the drum flows, the drying air return duct having an outlet, and a drying air delivery duct through which the drying air is sent back to the drum, the drying air delivery duct having an inlet; and the top forms a ready-to-mount moisture condensing module comprising lateral walls, an upper worktop surface, and a bottom surface, ready to be mounted to and close the cabinet for dehydrating drying air used to dry laundry within the drying drum of the laundry drying appliance, the top comprising a drying air inlet couplable to said outlet of the drying air return duct, a drying air outlet couplable to said inlet of the drying air delivery duct, fluid passageways defined inside the top from said drying air inlet to said drying air outlet for the passage of the drying air to be dehydrated, and a moisture condensing system arranged inside said fluid passageways comprising a heat pump evaporator fluidly coupled or couplable to a compressor body by means of a pipe, the compressor body being attached to a base element of the top, with a compressor body portion protruding from below the base element inside a cabinet inner volume, and a heat pump condenser downstream of said heat pump evaporator;

wherein the drying air return duct and the drying air delivery duct are rigidly connected directly to the cabinet at their top ends by respective brackets so as to be stationary with respect to the cabinet, to form automatic positioning and centering structure for the mounting of the top to the cabinet.

2. The laundry drying appliance of claim 1, wherein said outlet of the drying air return duct and said inlet of the drying air delivery duct are located at a top of the cabinet and face upwards, said drying air inlet and said drying air outlet are provided on the bottom surface and face downwards so as to match and be couplable to the outlet of the drying air return duct and to the inlet of the drying air delivery duct, respectively.

3. The laundry drying appliance of claim 1, wherein the drying air return duct is fluidly connected to a manifold which is also fluidly connected to a washing treatment products and water dispensing arrangement, the manifold having an inlet/outlet fluidly connected to the tub so as to receive drying air during a drying cycle and to deliver treatment products and water during a washing cycle, and wherein the manifold defines a siphon whereby an amount of liquid remains therein during the drying cycle to prevent drying air from leaking into the dispensing arrangement.

4. The laundry drying appliance of claim 3, wherein the top comprises a condense water drainage outlet for draining condense water released by the drying air upon passing through the moisture condenser, and wherein a condense water drainage conduit is provided fluidly connecting said condense water drainage outlet to said manifold.

5. The laundry drying appliance of claim 4, wherein said fluid passageways formed in the top for the drying air comprise a first air path portion extending from the drying air inlet to the moisture condenser, and a second air path portion extending from the moisture condenser to the drying air outlet.

6. The laundry drying appliance of claim 5, further comprising a condense water droplets separator provided in the second air path portion, for removing condense water droplets from the drying air before the drying air reaches the drying air outlet.

7. The laundry drying appliance of claim 6, wherein the water droplets separator further comprises a condense water tank fluidly connected to a sump and to a point of said second path portion downstream of the water droplets separator.

8. The laundry drying appliance of claim 1, wherein the top comprises a sump for storing at least part of the condense water released by the drying air, and wherein a water spraying system is provided adapted to take condense water present in said sump and spray the water into said drying air delivery conduit, the water being sprayed in correspondence with a dry air heater associated with said drying air delivery conduit for generating steam.

9. The laundry drying appliance of claim 1, wherein said drying air delivery duct comprises a drying air circulation fan.

10. The laundry drying appliance of claim 1, wherein said fluid passageways formed in the top for the drying air comprise a first air path portion extending from the drying air inlet to the moisture condenser, and a second air path portion extending from the moisture condenser to the drying air outlet.

11. The laundry drying appliance of claim 10, further comprising a defluff filter accommodated in the first air path portion.

12. The laundry drying appliance of claim 10, further comprising a condense water droplets separator provided in the second air path portion, for removing condense water droplets from the drying air before the drying air reaches the drying air outlet.

13. The laundry drying appliance of claim 12, wherein a condense water drainage outlet is provided in correspondence with said condense water droplets separator.

14. The laundry drying appliance of claim 12, wherein the water droplets separator further comprises a condense water tank fluidly connected to a sump and to a point of said second path portion downstream of the water droplets separator.

* * * * *